US009410383B2

(12) United States Patent
Jahnke et al.

(10) Patent No.: US 9,410,383 B2
(45) Date of Patent: Aug. 9, 2016

(54) METHOD AND APPARATUS FOR CONNECTING TUBULARS OF A WELLSITE

(71) Applicant: National Oilwell Varco, L.P., Houston, TX (US)

(72) Inventors: Douglas Aaron Jahnke, Houston, TX (US); Eric Trevor Ensley, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 364 days.

(21) Appl. No.: 14/025,566

(22) Filed: Sep. 12, 2013

(65) Prior Publication Data

US 2015/0068767 A1 Mar. 12, 2015

(51) Int. Cl.

| | |
|---|---|
| ***E21B 19/16*** | (2006.01) |
| ***E21B 17/08*** | (2006.01) |
| ***E21B 19/00*** | (2006.01) |

(52) U.S. Cl.

CPC ..... *E21B 19/16* (2013.01); *E21B 17/085* (2013.01); *E21B 19/002* (2013.01)

(58) Field of Classification Search

CPC ..... E21B 19/161; E21B 19/002; E21B 19/16; E21B 17/085; B23P 19/069; B23P 19/061; E25B 21/2002; E25B 28/00; E25B 23/0007; E25B 13/5016

See application file for complete search history.

(56) References Cited

U.S. PATENT DOCUMENTS

| | | | | |
|---|---|---|---|---|
| 4,712,620 | A | 12/1987 | Lim et al. | |
| 6,330,918 | B1 | 12/2001 | Hosie et al. | |
| 7,281,451 | B2 * | 10/2007 | Schulze Beckinghausen | E21B 19/164 81/57.16 |
| 8,020,626 | B2 | 9/2011 | Francis et al. | |
| 8,157,018 | B2 | 4/2012 | Francis et al. | |
| 8,281,856 | B2 | 10/2012 | Jahn et al. | |
| 8,297,347 | B2 | 10/2012 | Ruark et al. | |
| 8,347,972 | B2 | 1/2013 | Francis et al. | |
| 8,733,213 | B2 * | 5/2014 | Taggart | E21B 19/161 81/57.11 |
| 8,978,770 | B2 * | 3/2015 | DeBerry | E21B 17/085 166/344 |
| 2004/0049905 | A1 * | 3/2004 | Jansch | E21B 19/164 29/428 |
| 2004/0237726 | A1 * | 12/2004 | Schulze Beckinghausen | E21B 19/164 81/57.34 |

(Continued)

FOREIGN PATENT DOCUMENTS

| | | |
|---|---|---|
| GB | 2490376 | 10/2012 |
| WO | 2009135201 | 11/2009 |

OTHER PUBLICATIONS

Weathorford, Automated Rig Equipment, (2009-2012), 88 pages.

(Continued)

*Primary Examiner* — Jennifer H Gay
(74) *Attorney, Agent, or Firm* — JL Salazar Law Firm

(57) ABSTRACT

A clam assembly for connecting adjacent tubulars positionable in a wellbore of a wellsite for passing fluid therethrough comprises at least one drive mechanism. The clam assembly includes a plurality of segments selectively movable between an open position to receive the adjacent tubulars and a closed position positionable around the adjacent tubulars. The segments are disposable about a periphery of the adjacent tubulars. The drive mechanism is carried by the segments, and include a driver to drive a connector through the adjacent tubulars. The driver is movable between a retracted and an extended position to drive the connector whereby a connection is formed between the adjacent tubulars.

24 Claims, 35 Drawing Sheets

(56) References Cited

U.S. PATENT DOCUMENTS

2010/0025046 A1* 2/2010 Francis ..... B23P 19/069 166/380
2012/0006564 A1* 1/2012 Francis ..... B23P 19/069 166/377
2012/0227977 A1* 9/2012 Francis ..... B23P 19/069 166/360
2013/0255446 A1* 10/2013 Taggart ..... E21B 19/161 81/57.11
2013/0299178 A1* 11/2013 DeBerry ..... E21B 17/085 166/344
2015/0068766 A1* 3/2015 Jahnke ..... E21B 17/085 166/380
2015/0068767 A1* 3/2015 Jahnke ..... E21B 17/085 166/380
2015/0152693 A1* 6/2015 DeBerry ..... E21B 17/085 166/344
2015/0152694 A1* 6/2015 DeBerry ..... E21B 17/085 166/344
2015/0152698 A1* 6/2015 DeBerry ..... E21B 19/165 166/344

OTHER PUBLICATIONS

International Search Report and Written Opinion for PCT/US2014/052767 dated Feb. 24, 2015, 13 pages.

* cited by examiner

METHOD AND APPARATUS FOR CONNECTING TUBULARS OF A WELLSITE

BACKGROUND

The disclosure relates generally to techniques for performing wellsite operations. More specifically, the disclosure relates to techniques, such as tubulars and/or risers, for passage of fluid at a wellsite.

Oilfield operations may be performed to locate and gather valuable downhole fluids. Some such oilfield operations are performed at offshore locations. Surface platforms may be used to draw fluids from subsea locations to a surface vessel. A wellbore is drilled into the subsea floor and subsea equipment, such as blowout preventers, may be positioned about the wellbore to access fluid from subsurface formations.

A riser may extend from the subsea equipment, such as a blowout preventer stack positioned about the wellbore, to the surface platform. The riser may include a series of tubulars with flanged ends connected end to end by bolts to form an elongate fluid path for passage of fluids. Other tubulars, such as choke and kill lines, may also be provided along the riser for communication between the surface platform and the subsea equipment.

Various connection devices, such as spiders and torque wrenches, may be positioned on the surface platform to facilitate connection of the tubulars forming the riser. Examples of connection devices are provided in U.S. Pat. Nos. 8,020,626, 8,157,018 and 8,347,972, the entire contents of which are hereby incorporated by reference herein.

SUMMARY

In at least one aspect, the disclosure relates to a clam assembly for connecting adjacent tubulars positionable in a wellbore of a wellsite for passing fluid therethrough. The clam assembly includes a plurality of segments, and at least one drive mechanism. The segments are selectively movable between an open position to receive the adjacent tubulars and a closed position positionable around the adjacent tubulars, and are disposable about a periphery of the adjacent tubulars. The drive mechanisms are carried by the segments, and include a driver to drive a connector through the adjacent tubulars. The driver is movable between a retracted and an extended position to drive the connector whereby a connection is formed between the adjacent tubulars.

The clam assembly may also include an orienter carried by the segments, and engageable with a reference component of the tubulars whereby the segments are orientable about the tubulars. The orientor may include an upper receptacle and a lower receptacle. The upper receptacle includes a pair of arms defining an inlet to grippingly receive the reference component. The lower receptacle may include a plate defining a fixed inlet to receive the reference component. The segments may be pivotally connectable together. Each of the segments may include an upper plate and a lower plate with the at least one drive mechanism therebetween. The drive mechanism may include an axial mechanism to axial move the driver. The driver may include a rotational driver.

In another aspect, the disclosure relates to a connection assembly for connecting adjacent tubulars positionable in a wellbore of a wellsite for passing fluid therethrough. The connection assembly includes a base having a hole to receive adjacent tubulars therethrough, a carrier positionable about the base, and a clam assembly movably positionable along the carrier between a retracted position a distance from the tubulars and an extended position about the adjacent tubulars. The clam assembly includes a plurality of segments, and at least one drive mechanism. The segments are selectively movable between an open position to receive the adjacent tubulars and a closed position positionable around the adjacent tubulars, and are disposable about a periphery of the adjacent tubulars. The drive mechanisms are carried by the segments, and include a driver to drive a connector through the adjacent tubulars. The driver is movable between a retracted and an extended position to drive the connector whereby a connection is formed between the adjacent tubulars. The connection assembly of claim 10, wherein the carrier comprises rails, the clam assembly operatively connectable to the rails and slidably positionable therealong.

The carrier may include a support operatively connectable to the rails, with the clam assembly carried by the support. The base may include a plurality of clamps operatively connectable to the adjacent tubulars. The base may be operatively connectable to a platform at the wellsite. The base may be a spider. The clam assembly may also include an orienting bracket carried by the segments. The orienting bracket may be engageable with a reference component of the adjacent tubulars whereby the clam is orientable about the adjacent tubulars.

In yet another aspect, the disclosure relates to a method of connecting adjacent tubulars positionable in a wellbore of a wellsite for passing fluid therethrough. The method includes closing a clam assembly about the adjacent tubulars. The clam assembly includes a plurality of segments and at least one drive mechanism. The clam assembly is selectively movable between an open position to receive the adjacent tubulars and a closed position positionable around the adjacent tubulars. The segments are disposable about a periphery of the adjacent tubulars. The drive mechanism is carried by the segments, and includes a driver to drive a connector through the adjacent tubulars. The method also involves forming a connection between the adjacent tubulars with a connector by advancing the connector between a retracted and an extended position with the driver.

The clam assembly may also include an orienting bracket carried by the segments, and the method may also involve orienting a clam assembly about the reference component of the adjacent tubulars by grippingly engaging the reference component with the clam assembly. The method may also involve opening the clam assembly, extending the clam assembly to the adjacent tubulars, retracting the clam assembly from the adjacent tubulars, and/or movably positioning the clam assembly between a retracted position a distance from the adjacent tubulars and an extended position about the adjacent tubulars. The forming may involve rotating the connector and/or axially driving the connector.

In another aspect, the disclosure relates to a rotational driver for driving a connector through adjacent tubulars. The adjacent tubulars are positionable in a wellbore of a wellsite for passing fluid therethrough. The rotational driver includes a gearbox housing positionable about the connector, a socket carried by the gearbox housing to receivingly engage the connector, and a plurality of gears driven by at least one motor. The gears are operatively connectable to the socket to transfer torque from the at least one motor thereto, and have interlocking teeth defining a plurality of contacts therebetween whereby load on the gears is distributable therebetween.

The gears may include a plurality of pinion gears operatively connectable to a plurality motors and rotationally driven thereby, a drive gear operatively connectable to the pinions and rotationally driven thereby, a plurality of intermediate gears operatively connectable to the drive gear and rotationally driven thereby, and a socket gear operatively connectable to the intermediate gears and rotationally driven thereby. The intermediate gears have a plurality of teeth in constant engagement with the socket gear whereby torque is distributed between the intermediate gears during rotation thereof with the socket gear.

The gears may include a plurality of intermediate gears having interlocking teeth defining a plurality of contacts between the intermediate gears and the socket. The pinion gears may have teeth engageable with the drive gear. The drive gear may have a drive shaft. The drive shaft may have splines engageable with the intermediate gears. The pinion gears include two pinion gears. Each of the two pinion gears may have teeth engageable with the socket gear. The socket gear may have an aperture therethrough. A drive end of the socket may be receivable in the aperture. The motor may include a pair of hydraulic motors and the gears may include a pair of pinions. Each of the pinions may be operatively connectable to one of the hydraulic motors. The motors may include a pair of motors. A first of the motors may have a first rotational setting and a second of the motors may have a second rotational setting. The second rotational setting may be greater than the first rotational setting.

The rotational driver may also include a retainer operatively connectable to the gearbox and engageable with the connector whereby the connector is retainable in the socket during the advancing. The may include comprises a pivotal retainer bracket, a cylinder, a piston, and a wedge. The retainer bracket may be operatively connectable to the gearbox. The cylinder may be operatively connectable to the gearbox by the bracket. The piston may be extendable from the cylinder by the pivotal retainer bracket. The wedge may be engageable with the connector. The gearbox housing may be operatively connectable to an axial driver.

In another aspect, the disclosure relates to a drive assembly for connecting adjacent tubulars with connectors. The adjacent tubulars are positionable in a wellbore of a wellsite for passing fluid therethrough. The drive assembly includes an axial rail operatively connectable to a carrier and positionable thereby, a cylinder positioned on the base (the cylinder having a piston extendable therefrom), a bracket operatively connectable to an end of the piston and slidably positionable along the axial rail, and a rotational driver carried by the bracket. The rotational driver includes a gearbox positionable about the connector, a socket carried by the gearbox housing to receivingly engage the connector, a plurality of gears driven by at least one motor, and a socket having a receptacle to receivingly engage the connector. The gears are operatively connectable to the socket to transfer torque from the at least one motor thereto, and have interlocking teeth defining a plurality of contacts therebewteen whereby load on the gears is distributable therebetween, The socket is operatively connectable to the socket gear and driven thereby.

The carrier includes a frame and a plurality of rails. The carrier includes a bracket, a rolling frame, and a crane. The drive assembly may also include a clam assembly carried by the carrier. The axial rail may be operatively connectable to the clam assembly.

In yet another aspect, the disclosure relates to a method of connecting adjacent tubulars positionable in a wellbore of a wellsite for passing fluid therethrough. The method involves positioning the rotational driver about the tubulars. The rotational driver including a gearbox housing positionable about the connector, a socket carried by the gearbox housing to receivingly engage the connector, and a plurality of gears driven by at least one motor. The gears are operatively connectable to the socket to transfer torque from the at least one motor thereto, and have interlocking teeth defining a plurality of contacts therebewteen. The method also involves engaging the connector with the socket, and driving the connector through the adjacent tubulars by rotating the connector with the rotational driver and axially moving the rotational driver.

The may also involve selectively applying torque to the connector by rotating the gears with a first motor and applying additional torque to the connector by rotating the gears with a second motor, distributing load between the plurality of gears by engaging the gears along the plurality of contacts with the socket, and/or transferring torque from the motors to the socket with the gears.

Finally, in another aspect, the disclosure relates to a rotational driver for driving a connector through adjacent tubulars. The adjacent tubulars are positionable in a wellbore of a wellsite for passing fluid therethrough. The rotational driver includes a ratchet support positionable about the adjacent tubulars. a pawl housing slidably positionable along the ratchet support, a socket carried by the pawl housing to receivingly engage a connector (the socket rotationally driven by a motor), and a pawl selectively extendable from the pawl housing to engage the socket whereby the connector is rotatable.

The rotational driver may also include a ratchet lift operatively connectable to the ratchet support. The ratchet lift may also include a cylinder with a piston extendable therefrom. The piston may have a piston end operatively connectable to the ratchet support. The ratchet support may have a slot therethrough. The pawl housing may have a guide slidably positionable in the slot.

The rotational driver may also include a ratchet actuator operatively connectable to the pawl housing and the ratchet support. The pawl housing may be movable about the ratchet support by the ratchet actuator. The ratchet actuator may include a cylinder operatively connectable to the ratchet support and an actuator piston operatively connectable to the pawl housing. The pawl housing may have a pawl pocket to slidingly receive the pawl. The rotational driver may also include a motor having motor gears operatively connectable to the socket. The socket may be rotatable by the motor. The gears may include a motor gear driven by the motor and a ratchet gear. The ratchet gear may be operatively connectable to the socket to translate torque therebetween.

BRIEF DESCRIPTION DRAWINGS

So that the above recited features and advantages can be understood in detail, a more particular description, briefly summarized above, may be had by reference to the embodiments thereof that are illustrated in the appended drawings. It is to be noted, however, that the appended drawings illustrate only typical embodiments and are, therefore, not to be considered limiting of its scope. The figures are not necessarily to scale and certain features and certain views of the figures may be shown exaggerated in scale or in schematic in the interest of clarity and conciseness.

DETAILED DESCRIPTION

The description that follows includes exemplary systems, apparatuses, methods, and instruction sequences that embody techniques of the inventive subject matter. However, it is understood that the described embodiments may be practiced without these specific details.

A connection assembly for connecting adjacent tubulars, such as tubulars forming a riser extending between a platform and subsea equipment of a wellbore, is provided. The connection assembly includes a clam assembly movably positionable about the platform by a carrier. The clam assembly includes a plurality of segments movable between an open position and a closed position about the adjacent tubulars. The clam assembly includes an orienting bracket for locating the clam assembly about a reference component of the adjacent tubulars. The connection assembly also includes a drive mechanism to advance a connector between the adjacent tubulars to form a connection therebetween.

The connection assembly may be used to provide manual and/or automated make-up and/or break-up of tubular connections, such as connections between adjacent tubulars forming the riser. The clam assembly may be extendable and retractable for selective placement about the riser for connecting the adjacent tubulars. The connection assembly may be retractable from the tubulars at the platform to provide visual and/or physical access to the wellbore. Retraction may permit the connection assembly to be positioned for connection of the adjacent tubulars and/or moved away from equipment to prevent interference therewith.

Figure 1A:
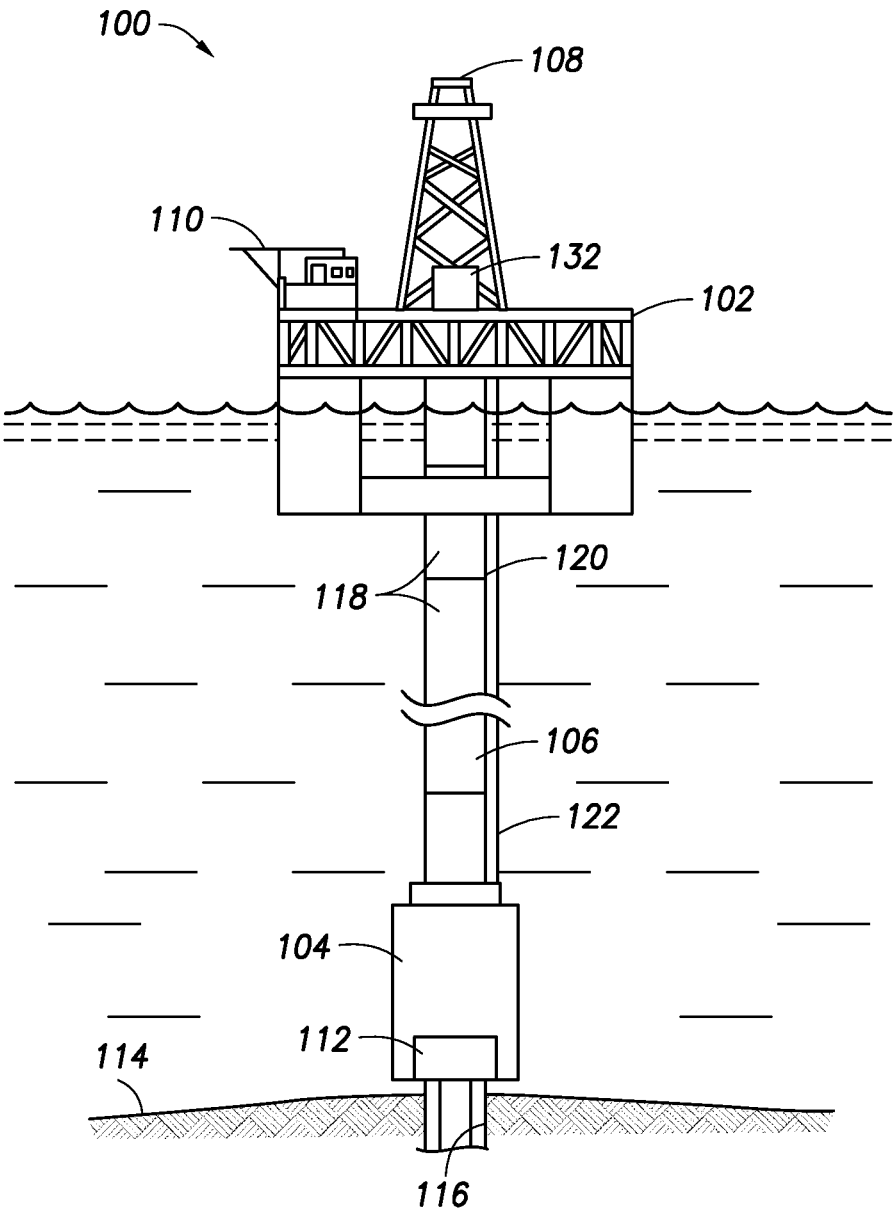
FIGS. 1A and 1B are schematic views of an offshore wellsite having a riser extending from a surface platform to subsea equipment, the adjacent tubulars of the riser extending through a connection assembly on the surface platform.
Figure 1B:
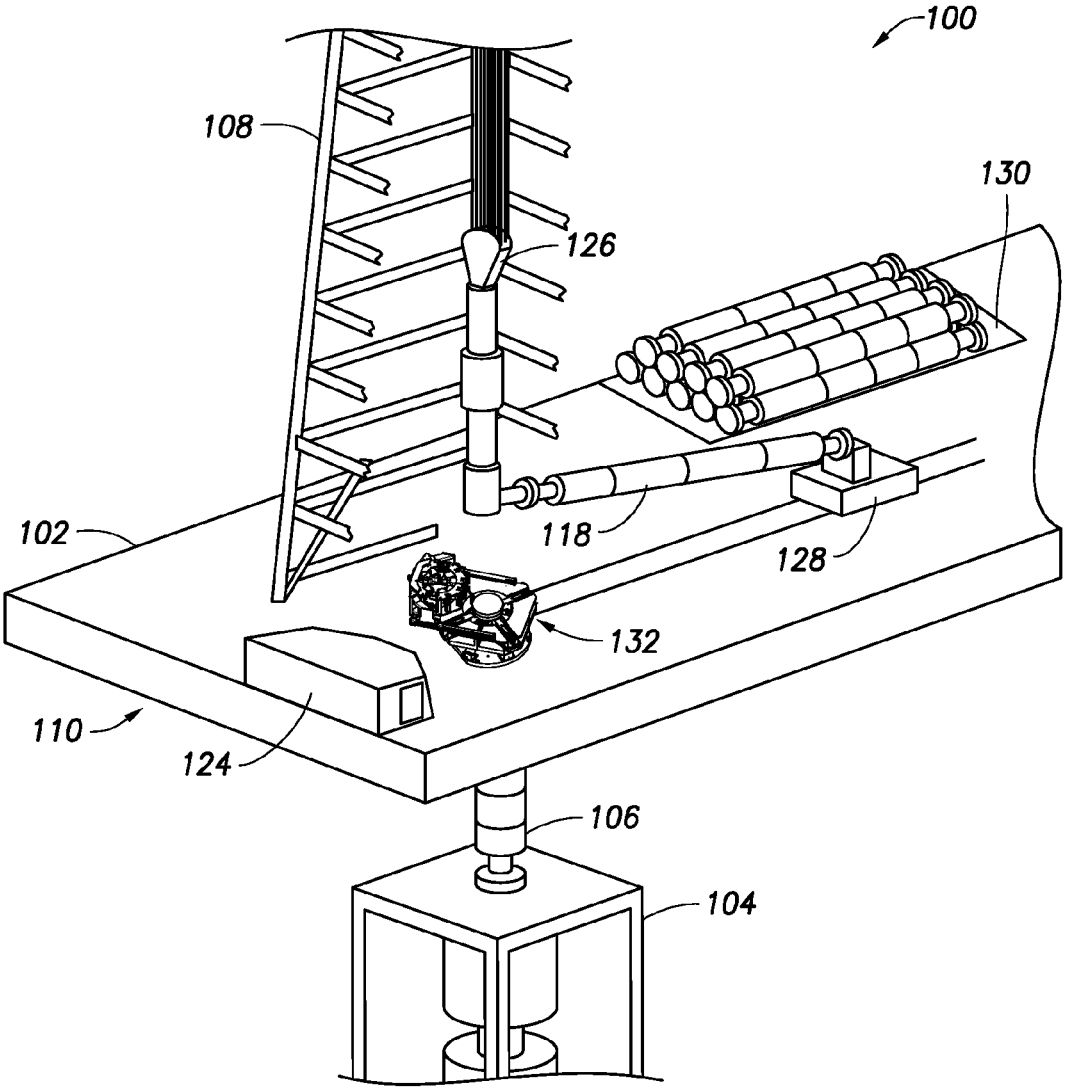

FIGS. 1A and 1B depict an example environment in which subject matter of the present disclosure may be utilized. These figures depict a wellsite 100 having a platform 102 and subsea equipment 104, with a riser 106 therebetween. The platform 102 has a rig 108 and other surface equipment 110 for operating the wellsite 100. The subsea equipment 104 is positioned about a wellhead 112 located on sea floor 114 adjacent a wellbore 116. The subsea equipment 104 is schematically depicted as a box adjacent the wellhead 112, but may be positioned about the sea floor 114 and may include various subsea components, such as strippers, blowout preventers, manifolds and/or other subsea devices for performing subsea operations.

The riser 106 is a system of tubulars 118 that form the riser 106 for joining the rig 108 on the platform 102 to the subsea equipment 104 on the sea floor 114. The riser 106 may be used to extend the wellbore 116 through the water and/or for allowing drilling mud to be captured as it returns to surface. The riser 106 may be a drill through umbilical line between the subsea equipment and the rig 108 at the surface.

The riser 106 may also be provided with one or more external conduits 122, such as electrical or fluid conduit (e.g., choke and kill, glycol, hydraulics, and/or riser-fill-up, etc.), for performing various functions, such as passing electrical signals and/or fluids between the platform 102 and the subsea equipment 104. The conduits 122 may include various tubing, cables or other communication mechanisms. The conduit(s) 122 may run along the riser 106 from the platform 102 to the subsea equipment 104.

The tubulars 118 may be tubular members with flanged ends joined to form the tubular connection 120 therebetween. The tubulars 118 may be, for example, tubing having a length of about 75 feet (22.86 m) in length. The tubular connections 120 may also support one or more of the conduits 122 in a desired configuration about the riser 106. The tubulars 118 and the tubular connections 120 may be modular for use with selected combinations of conduits 122. Each tubular connection 120 may be configured and selected for use with a selected tubular 118. The tubulars 118 and the tubular connections 120 may be configured to support the riser 106 and the conduits 122 in position in subsea conditions.

The surface equipment 110 may include a control room 124, draw works 126, a transporter 128, a storage facility 130, and a connection assembly 132. The control room 124 may include processing, control and/or communication equipment for operation of the wellsite 100. The control room 124 may be used to send/receive data, communication and/or control signals to/from the connection assembly.

The draw works 126 may include, for example, a Kelly, top drive, elevator, and/or other equipment, capable of supporting tubulars 118 during connection. The transporter 128 may be, for example, a riser delivery truck, used to carry the tubulars 118 from the storage facility 130 to a position on the platform 102 and/or to the draw works 126 for connection. One or more tubulars 118 may be pre-assembled for connection to the riser 106.

The connection assembly 132 is positioned on the surface platform 102 about an upper end of the riser 106 for supporting the tubulars 118 during connection. The connection assembly 132 may be positioned about a hole extending through the platform 102. The connection assembly 132 may be positionable about an upper end of the riser 106 for automatic and/or manual connection of tubulars 118 to the riser 106. The connection assembly 132 may be capable of moving to a position on the platform 102 for performing the connecting and to a position that avoids interference with equipment on the surface platform.

The tubulars 118 may be supported on the platform 102 by the draw works 126 and connected by the connection assembly 132 to an adjacent tubular extending through the platform. A series of tubulars 118 may be connected by the connection assembly to form the riser 106 extending below the platform 102.

While FIGS. 1A and 1B show a series of tubulars 118 forming a riser 106 in a subsea application, it will be appreciated that the connection assembly 132 may be used to connect tubulars 118 and tubular connections 120 may be used in a variety of land or water based oilwell applications.

Connection Assembly

Figure 2A:
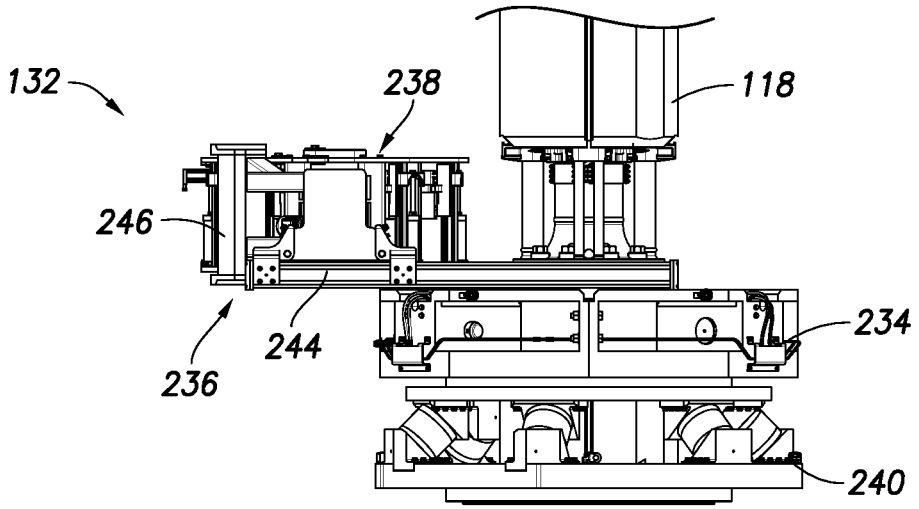
FIGS. 2A and 2B are schematic side and perspective views of the connection assembly disposed about adjacent tubulars, the connection assembly including a clam assembly and a carrier.
Figure 2B:
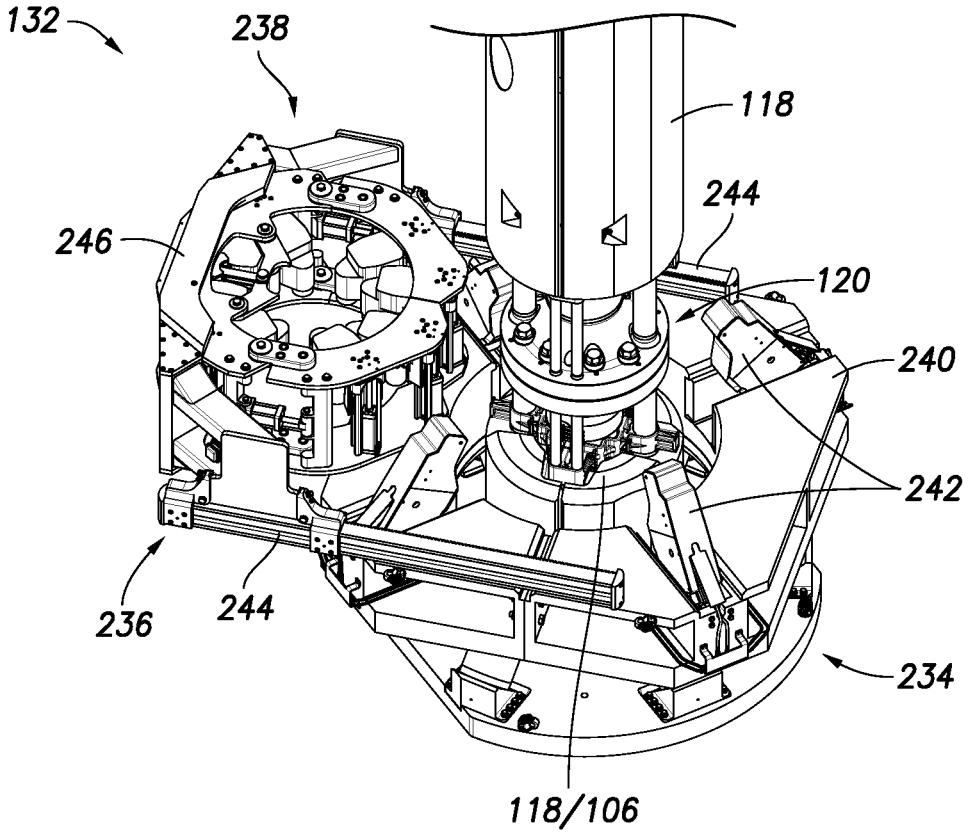

FIGS. 2A and 2B show side and perspective views of the connection assembly 132 positionable about tubulars 118 for connection thereof. The connection assembly 132 includes a riser support (e.g., a spider) 234, a carrier 236, and a clam assembly 238. The riser support 234 is positionable on the platform 102 for supporting the tubular 118 at a surface end of the riser 106 extending below the platform 102. The riser support 234 includes a flanged body 240 with a hole extending therethrough and clamps 242. The hole of the riser support 234 is aligned with a hole of the platform 102 for passing tubulars 118 therethrough. The clamps 242 may be engageable with the tubular 118 of the riser 106 for supporting the tubular 118 during connection. Examples of devices usable as the riser support 234 are provided in U.S. Pat. Nos. 8,020,626, 8,157,018 and 8,347,972, previously incorporated by reference herein.

The carrier 236 may be any transport mechanism capable of transporting the clam assembly 238 into and out of position about the riser 106 for connecting of the tubulars 118. The carrier 236 may be mounted to the riser support 234 via any method that provides movement (e.g., linear movement) of the clam assembly 238. The clam assembly 238 is removably connectable to the carrier 236. As shown, the carrier 236 includes a pair of rails 244 with a frame 246 thereon. The rails 244 are positionable on the riser support 234 with the frame 246 slidably positionable therealong. The riser support 234 is configured to carry the clam assembly 238 between a retracted position a distance from the riser 106 and an engagement position about the riser 106. The carrier 236 may also be used to move the clam assembly 238 away from and/or out of the way of the surface equipment 110 and/or tubulars 118.

Figure 3A:
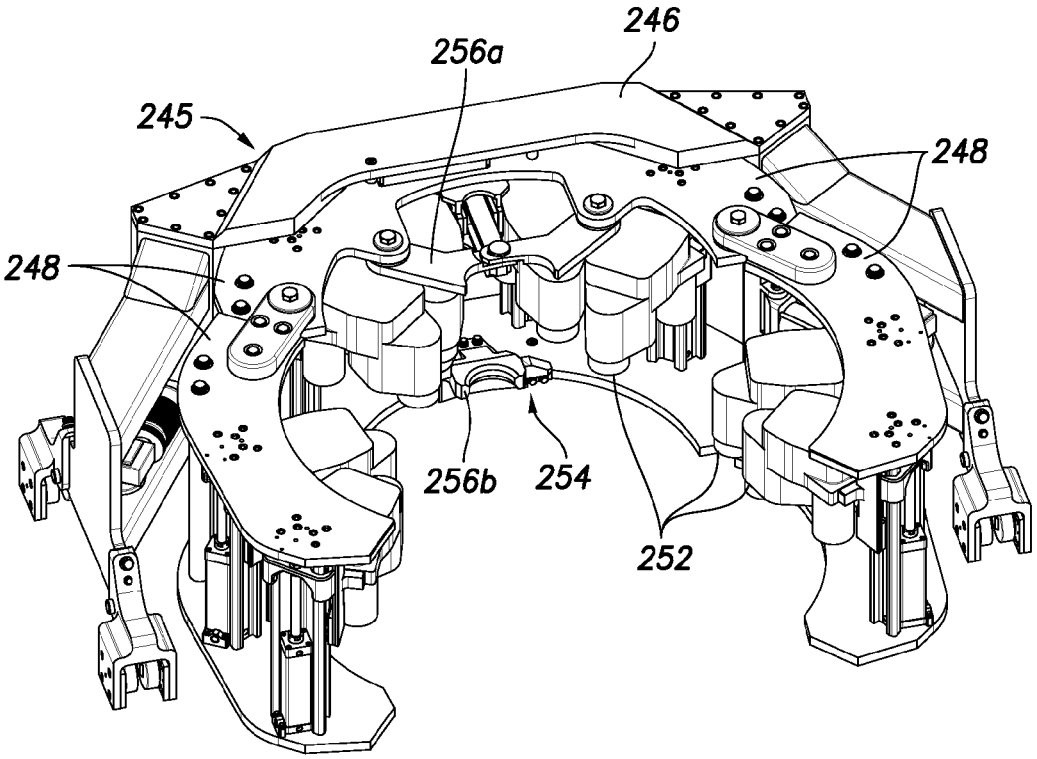
FIGS. 3A and 3B are schematic perspective and exploded views of the clam assembly and carrier.
Figure 3B:
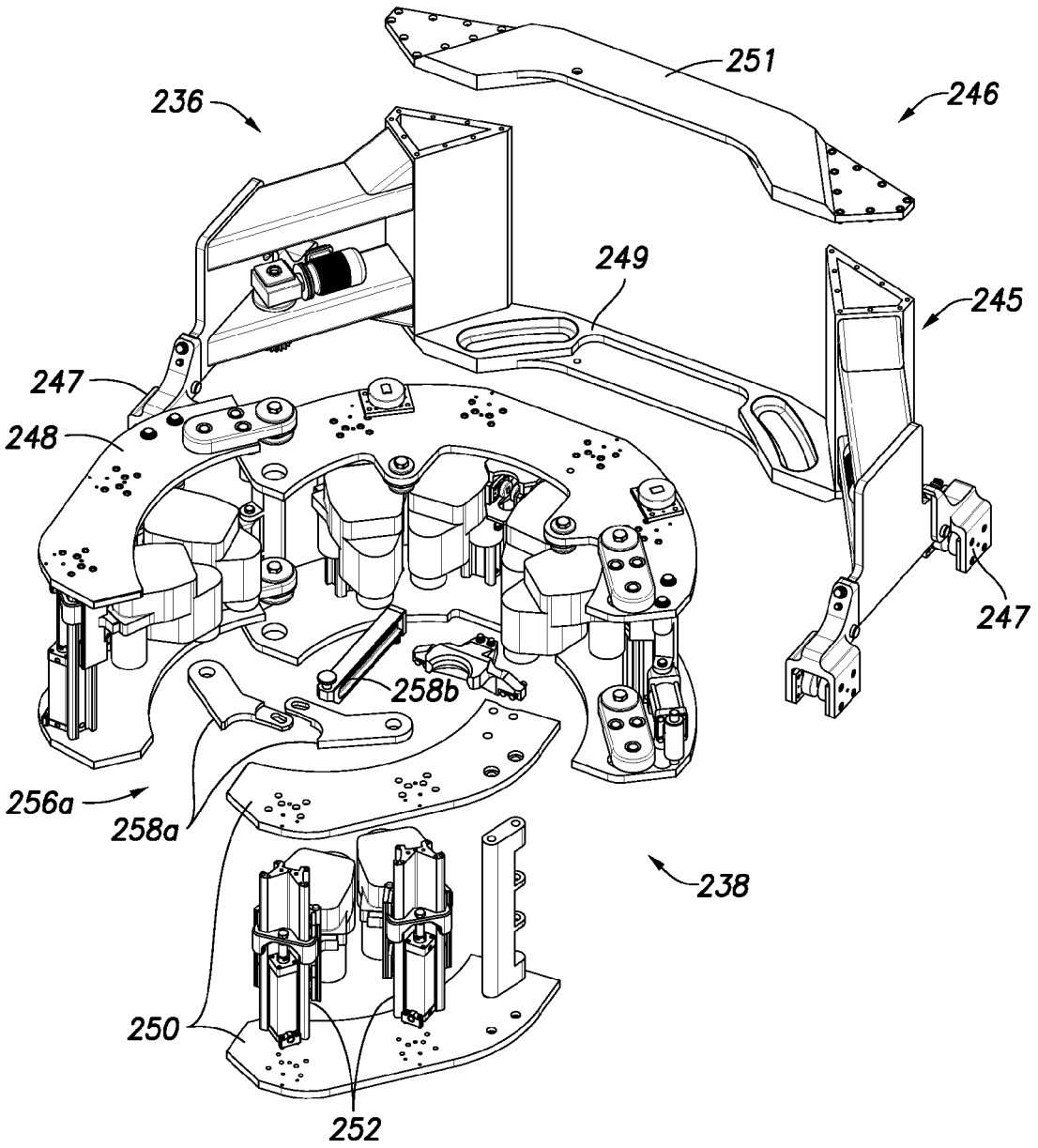

As shown in greater detail in FIGS. 3A and 3B, the frame 246 includes a brace 245 with rail supports 247 slidably positionable along the rails 244 (FIGS. 2A and 2B). The brace 245 has vertical side portions with a bottom portion 249 extending therebetween for supporting the clam assembly 238 thereon. A locking plate 251 is positionable on the vertical side portions of the brace 245 for securing the clam assembly 238 therebetween.

As also shown in FIGS. 3A and 3B, the clam assembly 238 includes a plurality of segments 248 pivotally connected and movable between an open and a closed position. The clam assembly 236 may be hinged and separated into two or more portions with the ability to open and clear the tubulars 118 as it approaches, and to close about the tubulars 118 (see, e.g., FIG. 2B) for forming connections 120 between the tubulars.

Segment plates 254 are provided for connection between the segments 248. Each of the segments 248 includes upper and lower segment brackets 250 with at least one drive mechanism 252 therebetween. As shown, the clam assembly 238 includes three curved segments 248, a central segment with two lateral segments pivotally connected thereto. The central segment 248 of the clam assembly 238 is supported between the vertical side portions and bottom portion of the brace 245. The lateral segments 248 are pivotally movable about the central segment 248 of the clam assembly 238.

The clam assembly 238 contains as many drive mechanisms 252 as there are connectors to be driven through the tubulars 118. Each of the drive mechanisms 1152 may have independent axial movement to independently respond to variations, such as variable advancing and retracting of the connectors due to, for example, friction, lubrication, fluid flow, etc.

The clam assembly 238 is also provided with an orienter 254 for positioning the clam assembly 238 about the tubulars 118 for connection. As shown, the orienter 254 includes a support key **256*a* and a position key 256*b*. The support key 246*a* may have a fixed inlet to receivingly engage a reference component, such as one of the conduits 122, of the tubulars 118. The position key 256*b* includes pivoting arms 258*a* supported by a linear arm 258*b*. The pivot arms 258*a*** may grippingly engage the reference component.

Figure 4A:
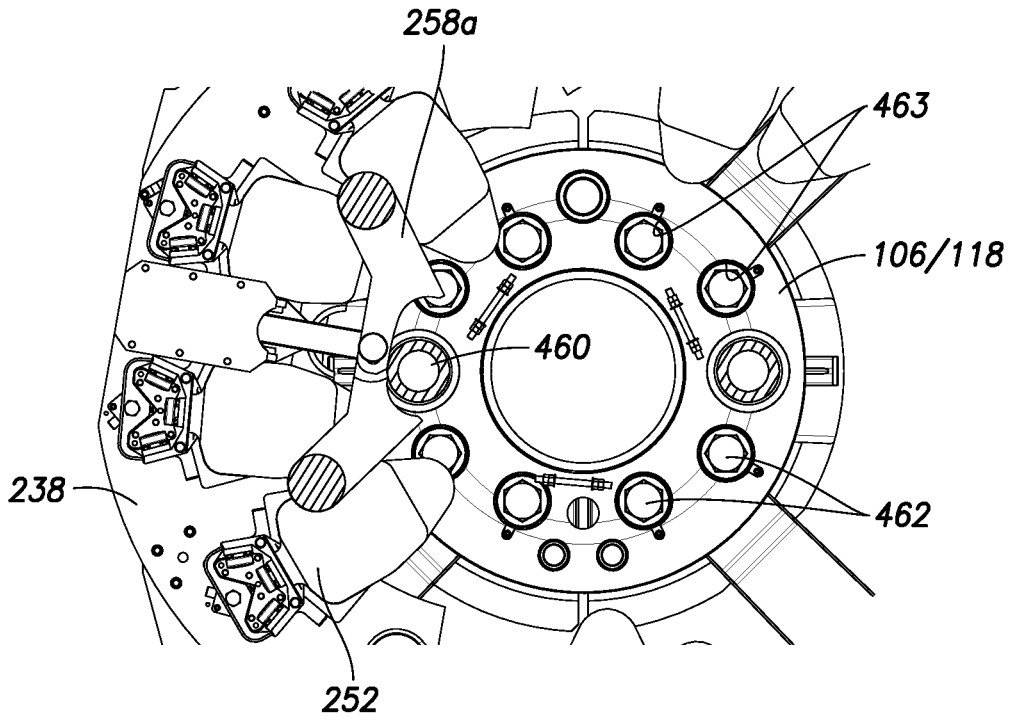
FIGS. 4A and 4B are schematic top views of an orienting bracket of the clam assembly in an open and a closed position, respectively, about the tubular.
Figure 4B:
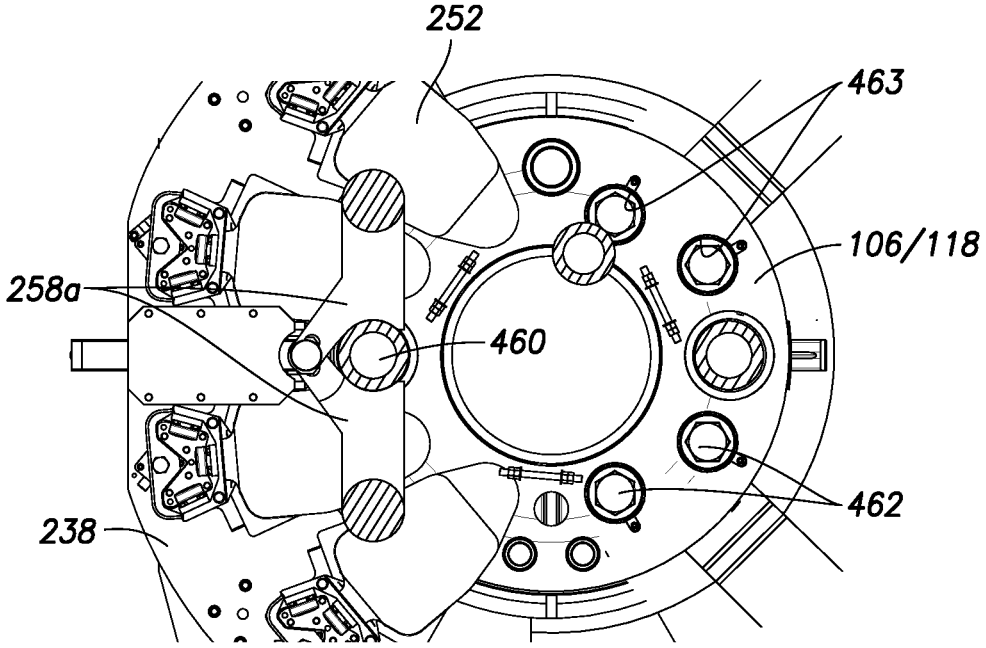

The engagement of the support key **246*a* and the position key 256*b* may be used to orient the clam assembly 238 about the tubulars 118 during connection. FIGS. 4A and 4B show the orienter 254 in an open and closed position, respectively, about a reference component 460 of a riser 106. In this example, the reference component 460 may be one of the conduits 122 (e.g., a choke or kill line) extending along the tubulars 118 and the riser 106**.

In FIG. 4A, the pivoting arms 258 are in the open position to define an inlet for receivingly engaging the reference component 460. The pivoting arms 248 may be movably positionable for grippingly engaging the reference component 460. Once secured in position with the orienter 254, the segments 248 of the clamshell assembly 238 may close to surround the tubulars 118.

In FIG. 4B, the pivoting arms 258 are in the closed position to grippingly receive the reference component 460. In this position, the clam assembly 238 is secured to the riser 106 at a known orientation. With the support key **256*a* and the position key 256*b* locked about the reference component 460, the clam assembly 238 is oriented about a known position on the tubulars 118. Other components of the riser 106, such as connectors (e.g., bolts) 462 and openings 463 in the tubular, are now also in known positions relative to the orienter 254. With the clam assembly 238 positioned about the tubulars 118, the drive mechanisms 252 may be disposed in predetermined positions about the tubulars 118. For known dimensions of the tubulars 118 and connectors 462, the drive mechanisms 252 may be positioned on the clam assembly 238** such that, when oriented about the reference component 460, the drive mechanisms 252 are positionable about holes of the tubular 118 for driving connectors 462 therein.

FIGS. 5A-5B through 8A-8B depict the connection assembly 132 in various positions during operation. FIGS. 5A-8A show top views of the connection assembly 132 in the various positions. FIGS. 5B-8B show perspective views of the connection assembly 132 in the various positions.

Figure 5A:
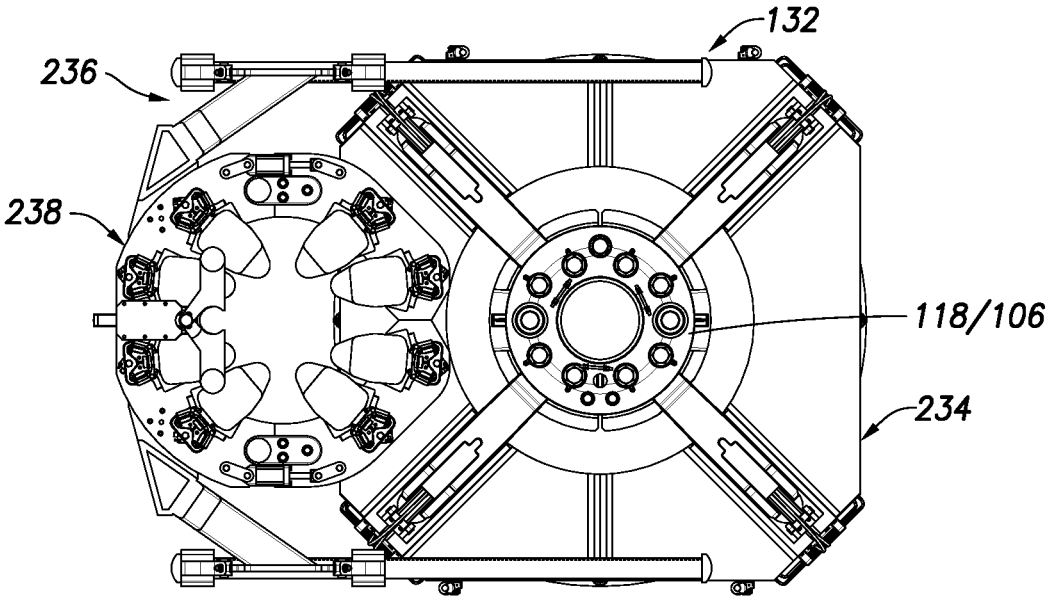
FIGS. 5A-5B through 8A-8B are schematic top and perspective views, respectively, of the connection assembly in various positions during engagement about the adjacent tubulars.
Figure 5B:
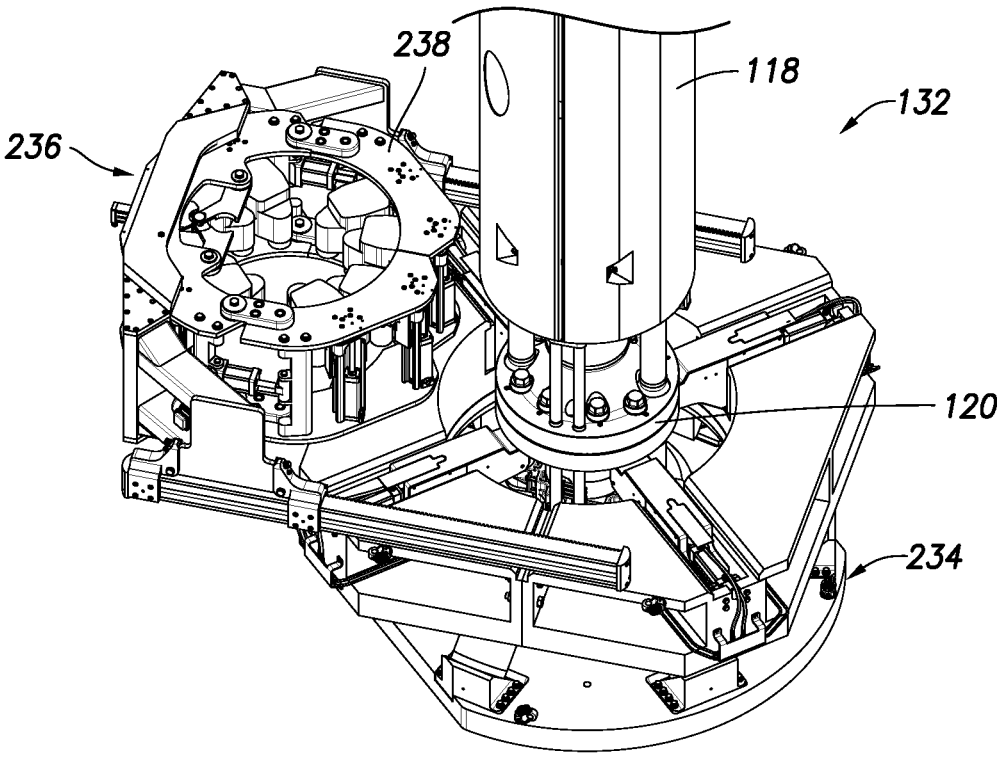

As shown in FIGS. 5A-5B, the clam assembly 238 is in a retracted position along the carrier 236 away from the riser 106 with the segments 248 in a closed position. The riser support 234 is clamped about the riser 106, and an additional tubular 118 is positioned adjacent to tubular 118 of the riser 106 for forming the connection 120 therebetween.

Figure 6A:
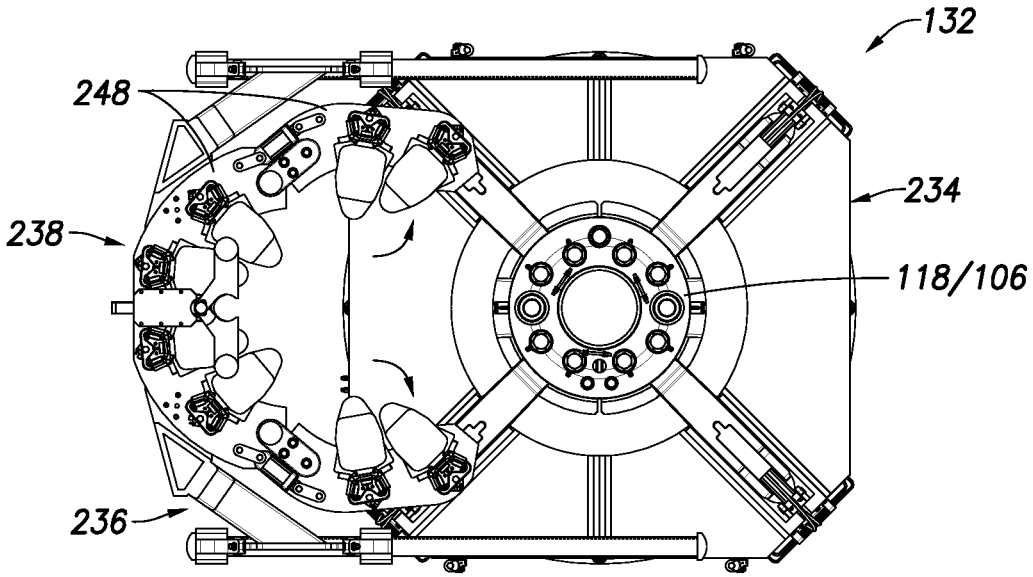
Figure 6B:
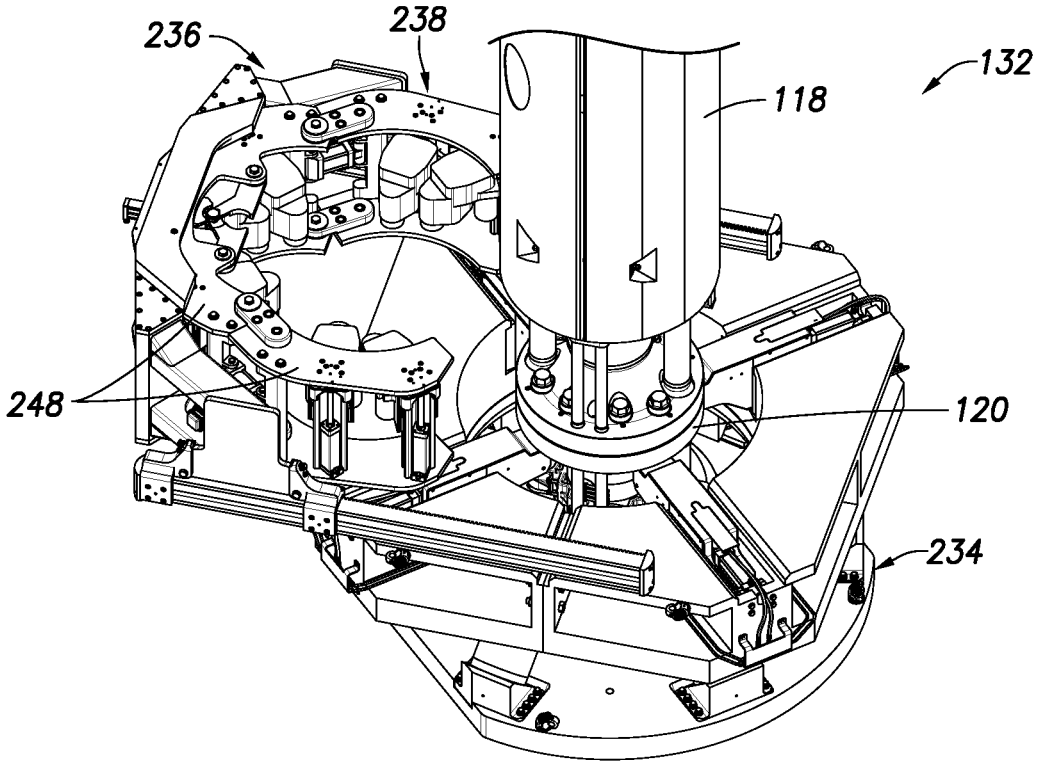
Figure 7A:
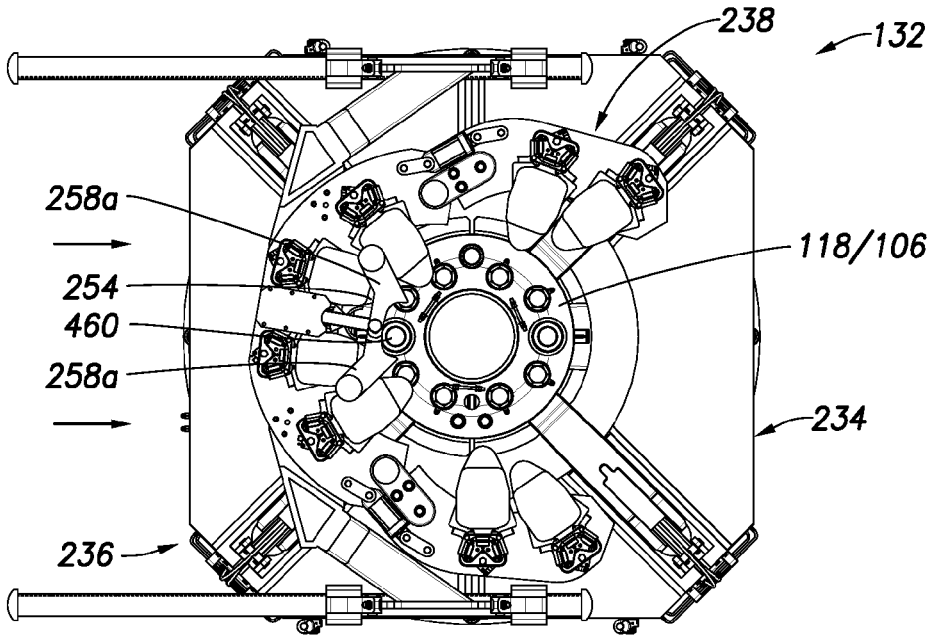
Figure 7B:
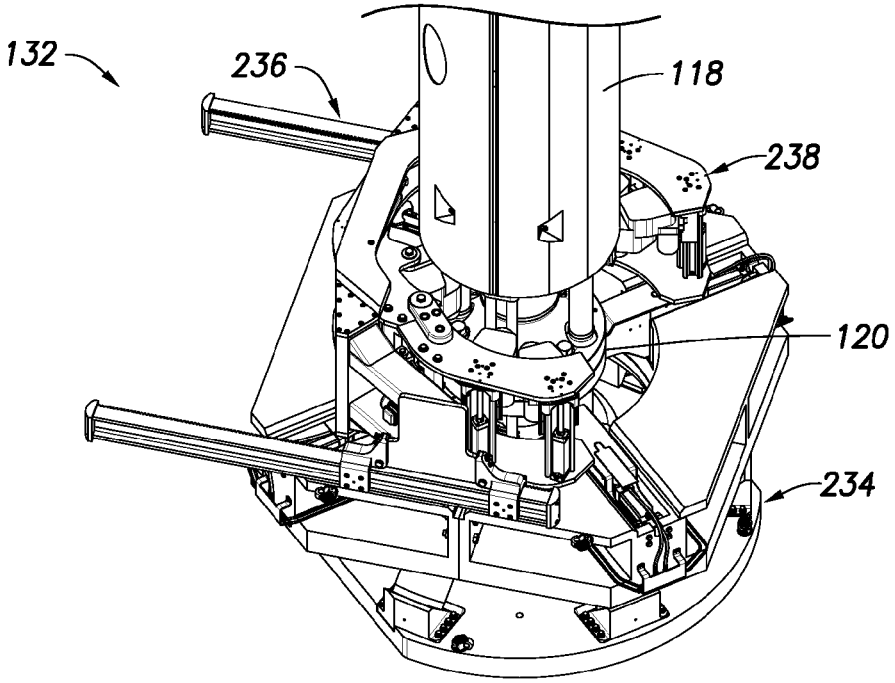

As shown in FIGS. 6A-6B, the segments 248 of the clam assembly 238 have pivotally moved to an open position to receive the tubulars 118. As shown in FIGS. 7A-7B, the carrier 236 has moved the clam assembly 238 to an extended position for engagement with the tubulars 118. With the segments 248 in the open position, the clam assembly 238 slides along the rails 244 of the carrier 236 to a position adjacent the tubular 118. The arms 258*a* of the orienter 254 receive the reference component 460, and the segments 248 begin surrounding the tubular 118.

Figure 8A:
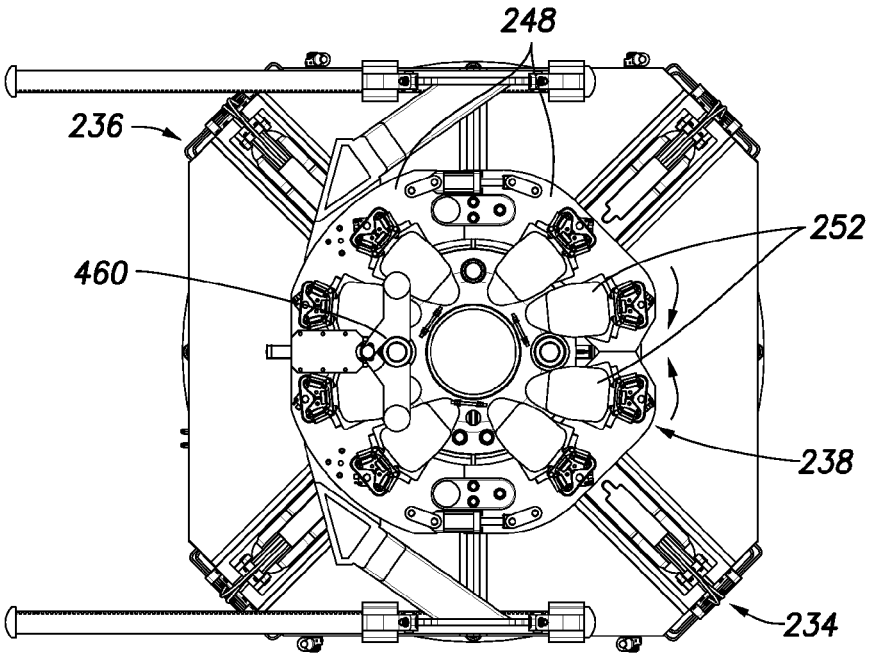
Figure 8B:
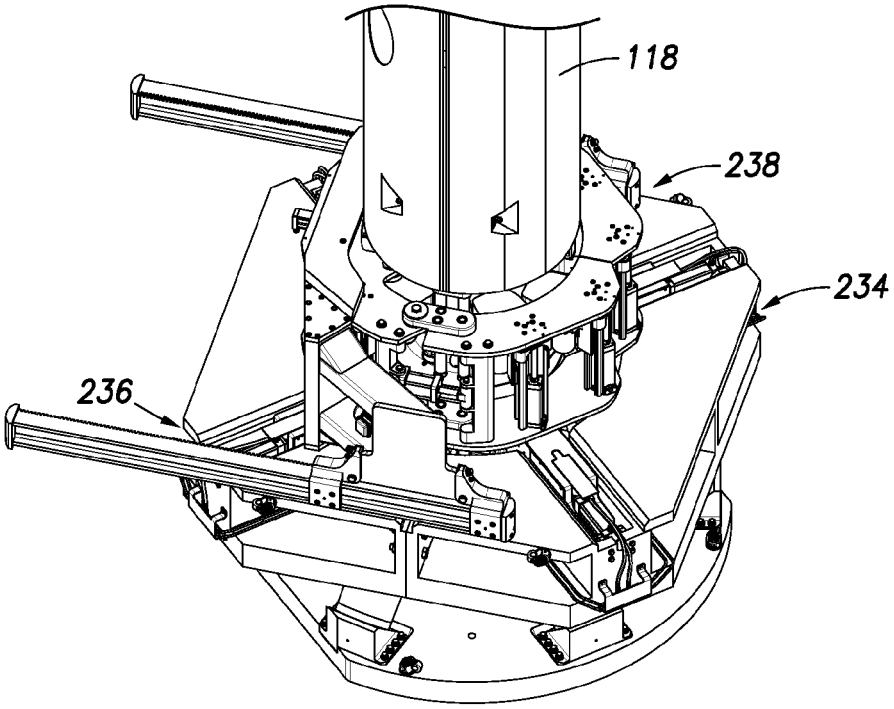

As shown in FIGS. 8A-8B, the segments 248 are moved to a closed position surrounding the tubular 118, and the orienter 254 grippingly engages the reference component 460. In this position, the clam assembly 238 is secured about the tubular 118 in a known position relative to the reference component 460. The drive mechanisms 252 are positioned along the segments 248 such that, when the segments 248 are closed about the tubular 118 and oriented by orienter 254, the drive mechanisms 252 are positioned about openings 463 for driving connectors 464 therethrough (see, e.g., FIGS. 4A and 4B). Adjacent tubulars 118 may be fastened together by disposing the connectors (e.g., bolts) 462 through the flanged ends of the tubulars 118 using the drive mechanism 252.

Sensors may be disposed about the connection assembly to monitor parameters thereof during operation. The control room 124 or other surface equipment 110 (FIG. 1B) may be provided with processing and/or control units for collecting data, performing analysis, sending control signals, and generating reports (e.g., control curve plots). The surface equipment 110 may be used, for example, to provide real time feedback for automatic or manual operation and/or adjustment. For example, sensors may be positioned about the orienter, plurality of segments and/or carrier to provide information about position that may be used to adjust placement as needed.

A time period for forming a riser 106 may include a length of time it takes to fasten each tubular 118 of the riser 106 together. For example, 100 tubulars connected at 30 minutes per tubular may take a total of about 50 hours to connect. The connection may be performed manually (e.g., by an operator equipped with a hydraulic torque wrench/driver) or automatically. An automated process may be used to provide a predetermined connection time, for example, of about five minutes for bolting the tubulars and about five minutes to lower the tubular, for a total time of about 16.7 hours for forming a riser of 100 tubulars.

Figure 9A:
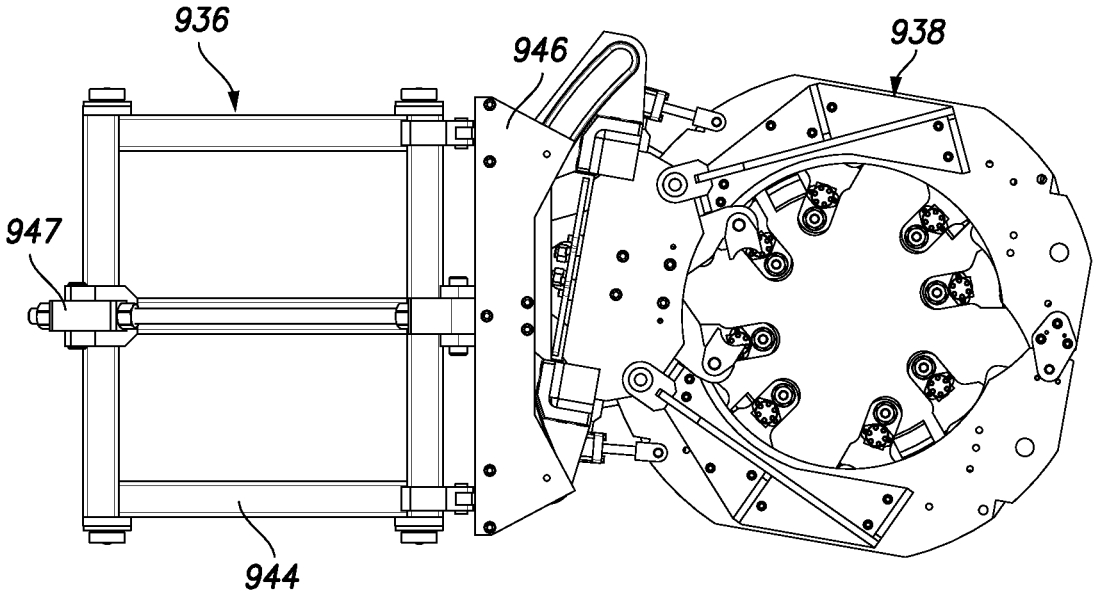
FIGS. 9A and 9B are schematic top and perspective views, respectively, of an alternate clam assembly and carrier.
Figure 9B:
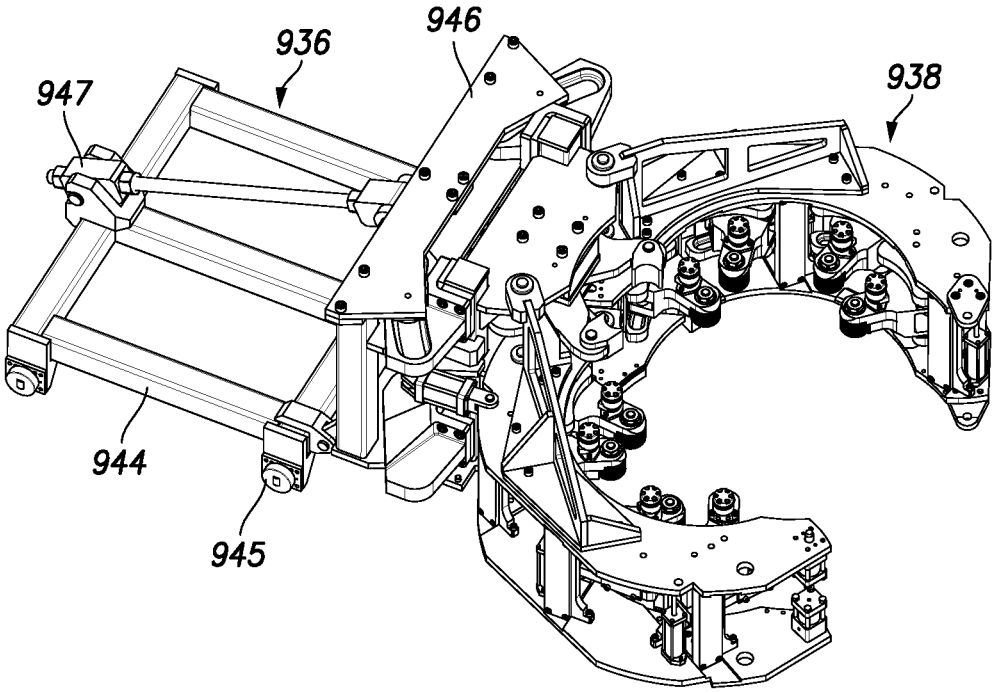
Figure 10A:
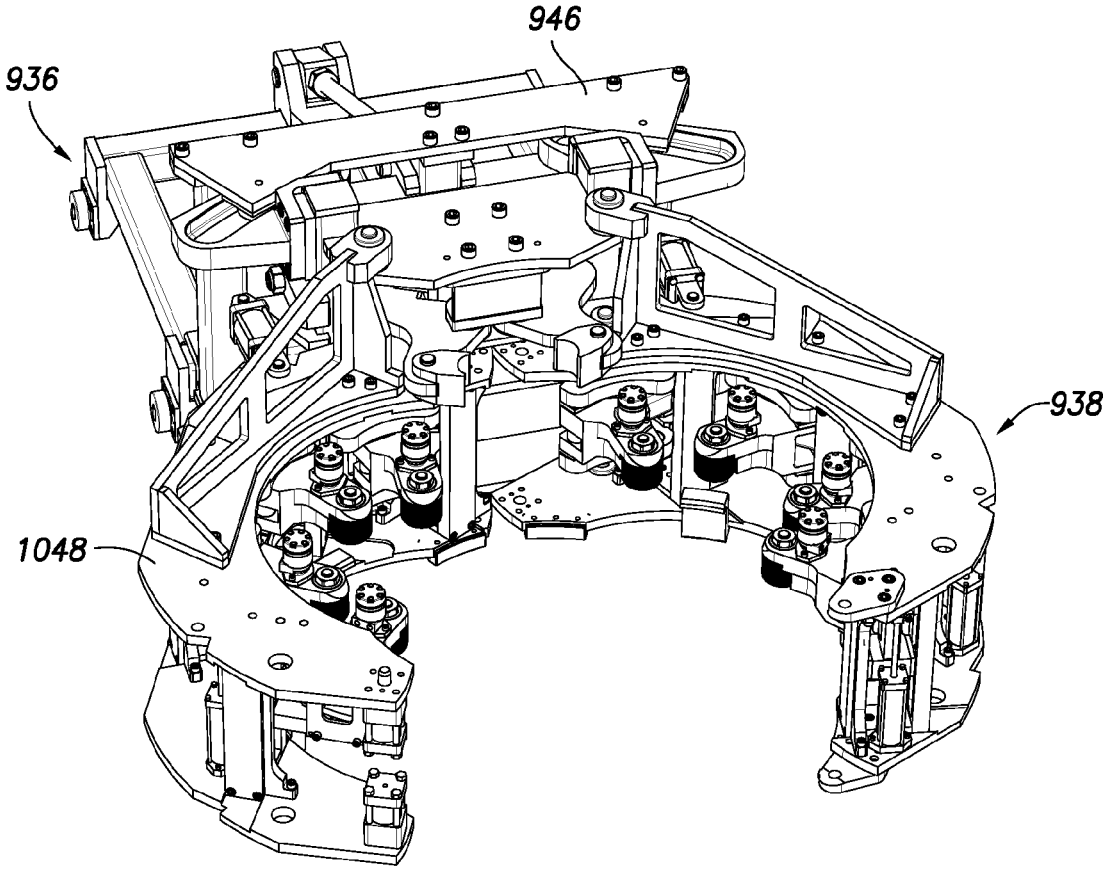
FIGS. 10A and 10B are schematic perspective and exploded views of the alternate clam assembly and carrier.
Figure 10B:
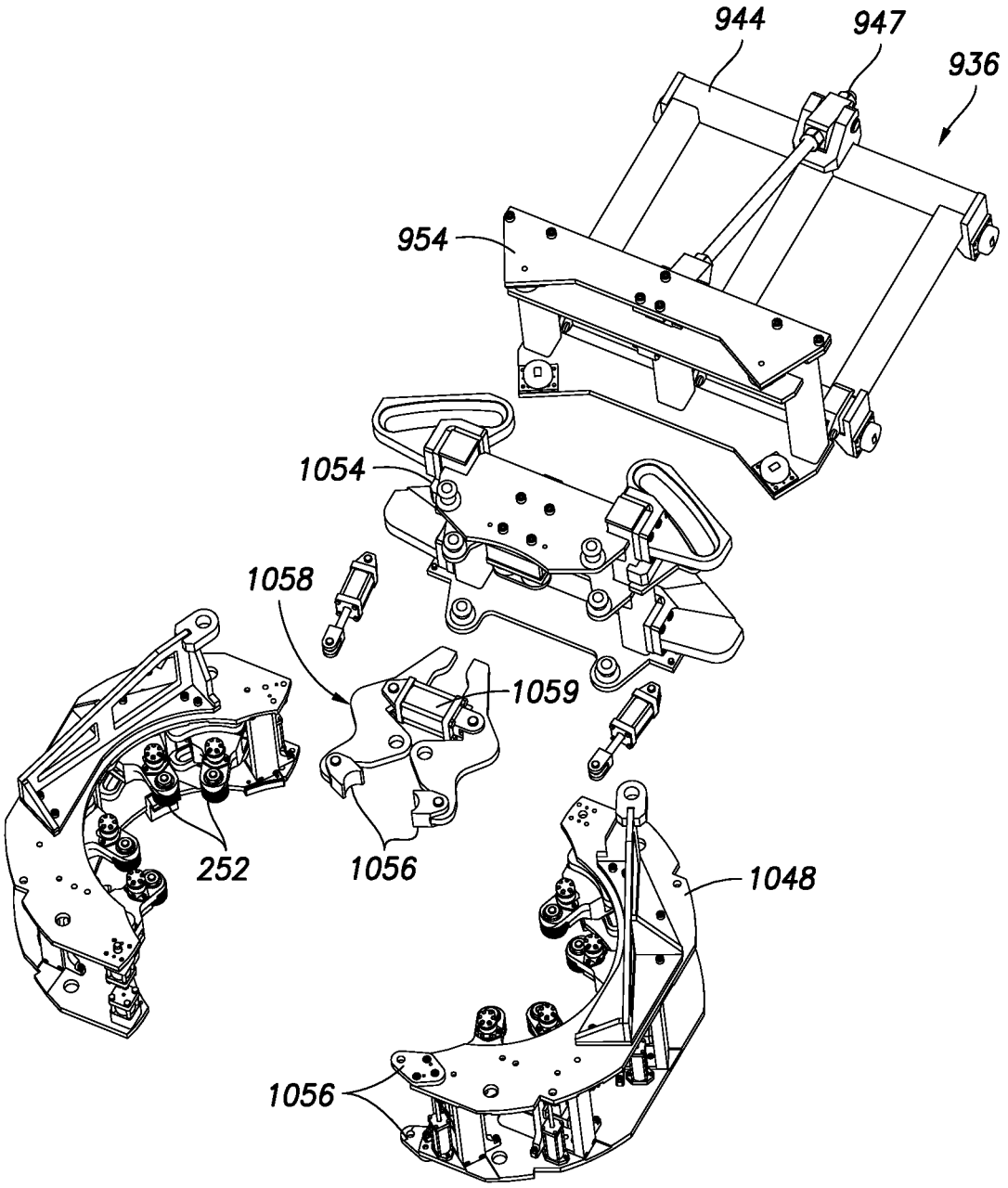

FIGS. 9A-10B show an alternate carrier 936 and clam assembly 938. FIGS. 9A and 9B show perspective and top views, respectively, of the clam assembly 938 carried by the alternate carrier 936. FIGS. 10A and 10B show perspective and exploded views of the clam assembly 938. This alternate version employs a rolling carrier 936 positionable about the riser support 234 and/or platform 102 (FIG. 2B). This alternate version is similar to the carrier 936 and clam assembly 238 previously described, but demonstrates some possible variations.

In this version, the carrier 936 includes car 944, a frame 946, and a crane 947. The car 944 has rollers 945 for movably positioning the clam assembly 938. The frame 946 is operatively connectable to the clam assembly 938. The crane 947 is movably connectable between the frame 246 to the car 944. The crane 947 may be used to lift and/or translate the frame 946. The frame 946 is movably mounted on the car 946 by the crane 947 to carry the clam assembly 938 into position about the riser support 234 for connection of the adjacent tubulars 118.

As shown in FIGS. 10A and 10B, the clam assembly 938 includes a plurality of segments 1048 pivotally connected and movable between an open and a closed position. Connector plate 1054 is provided for connection between the segments 1048. Each of the segments 1048 includes upper and lower brackets 1050 with at least one drive mechanism 252 therebetween.

As shown, the clam assembly 1038 includes two curved segments 1048 with the connector plate 1054 therebetween. The segments 1048 are pivotally movable about the connector plate 1054 of the clam assembly 938. The connector plate 1054 of the clam assembly 938 is operatively connected to a base portion of the frame 1045. The frame 946 includes the base portion with two lateral wings extending therefrom. Each of the wings is operatively connected to the segments 1048 for supporting the segments about the frame 946.

The clam assembly 938 is also provided with an orienter 1058 for positioning the clam assembly 938 about the reference component 460 on the riser 106 (see, e.g., FIGS. 4A and 4B). As shown, the orienter 254 includes pivoting grip arms 1056 with a spring 1059 therebetween. The grip arms 1056 define an inlet for receiving the reference component 460. The grip arms 1056 are movably positionable for grippingly engaging the reference component 460.

Figure 11A:
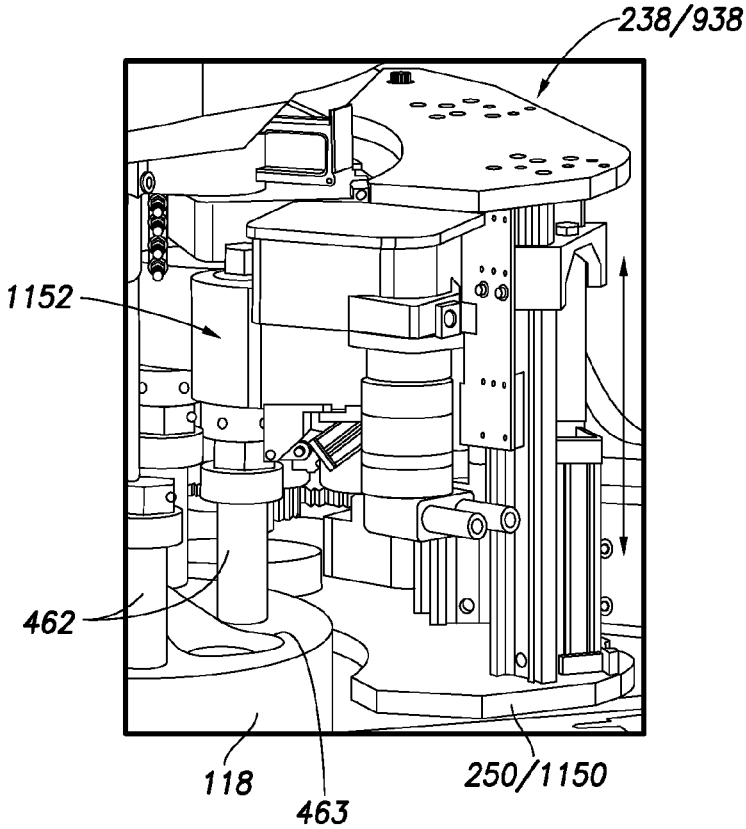
FIGS. 11A-11E are schematic perspective and exploded views of a drive mechanism.

FIGS. 11A-13C show various views of a drive mechanism 1152 usable with the clam assemblies 238 and 938. FIG. 11A shows a drive mechanism 1152 carried by the clam assembly 238, 938 and positioned adjacent tubulars 118 for driving connectors 462 into the tubulars 118. FIGS. 11B-11D show the drive mechanism 1152 in various positions as the connector 462 is driven into the adjacent tubulars 118. FIGS. 12A and 12B show front and back perspective views of the drive mechanism 1152. FIGS. 11E and 12C show exploded views of the drive mechanism 1152.

The drive mechanism 1152 includes an axial rail 1160, a lift 1162, a rail bracket 1164, and a rotational driver 1166. The axial rail 1160 is supported between upper and lower brackets 250, 1050 of the clam assembly 238, 938. The axial rail 1160 has a track therealong for receiving the rail bracket 1164. The lift 1162 includes a cylinder 1166 with a piston 1168 extendable therefrom and a piston bracket 1170 on an end of the piston 1168.

The lift 1162 is supported on the lower bracket 250, 1150 adjacent the axial rail 1160 with the piston bracket 1170 movably positionable along the axial rail 1160. The rail bracket 1164 is operatively connectable to the lift cylinder 1166 and movable along the axial rail 1160 thereby. The rail bracket 1164 is also operatively connectable to the rotational driver 1166 for slidably positioning the rotational driver 1166 along the axial rail. The drive mechanisms 1152 may be horizontally positionable along the rail 1160 to adapt to various riser configurations.

The rotational driver 1166 may be any driver capable of advancing the connector 462 into the adjacent tubulars 118 of the riser 106 to form a connection 120 therebetween. For example, the rotational driver 1166 may be a torque tool capable of rotationally driving a bolt into threaded openings 463 in the tubulars 118. The rotational driver 1166 may be, for example, a rotating wrench capable of receiving a hex head of a bolt and rotationally driving the bolt into threads in the openings 463 in tubulars 118. While a rotational driver 1166 is described and depicted, other drivers may be used to drive the connectors 462.

Figure 11B:
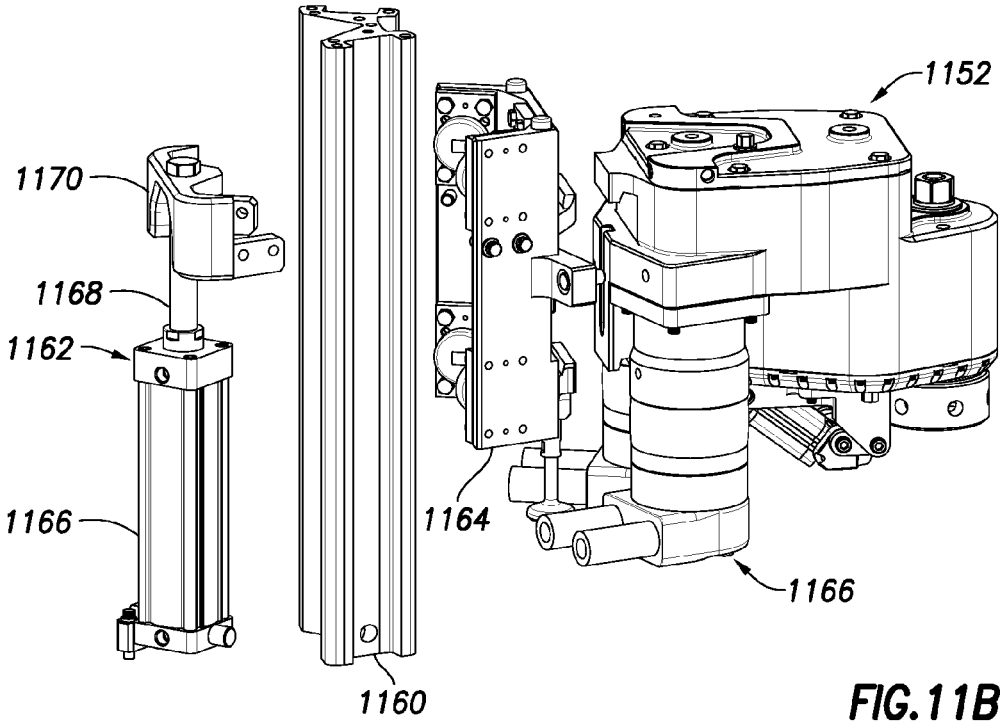
Figure 11E:
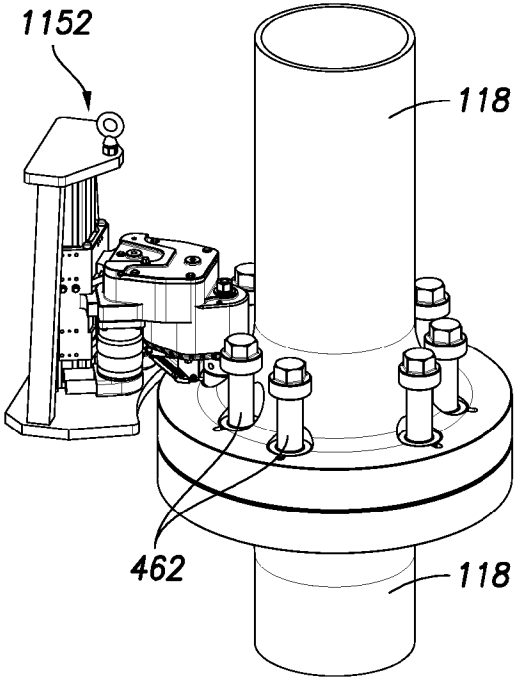
Figure 11D:
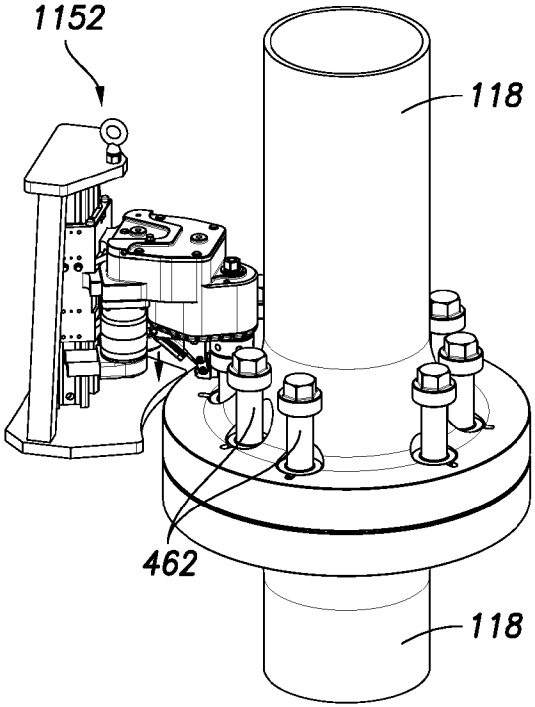
Figure 11C:
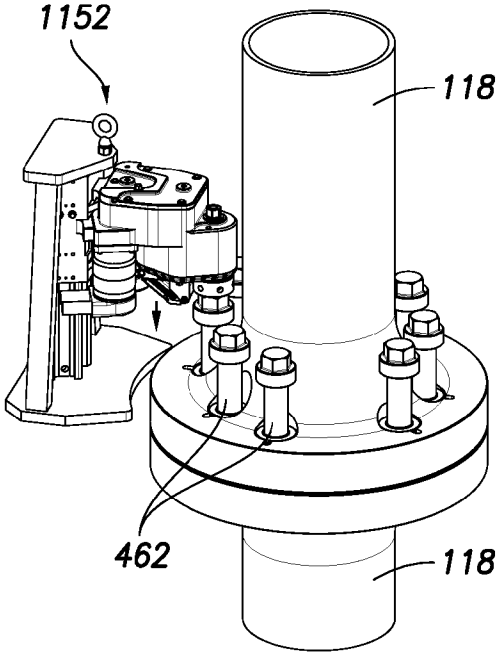
Figure 12C:
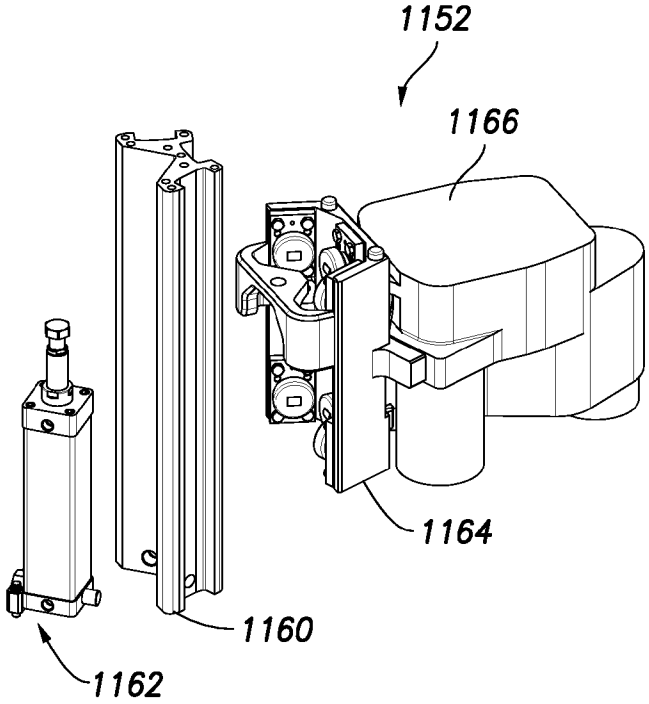
FIGS. 12A-12C are schematic front perspective, back perspective and assembly views of the drive mechanism.
Figure 12B:
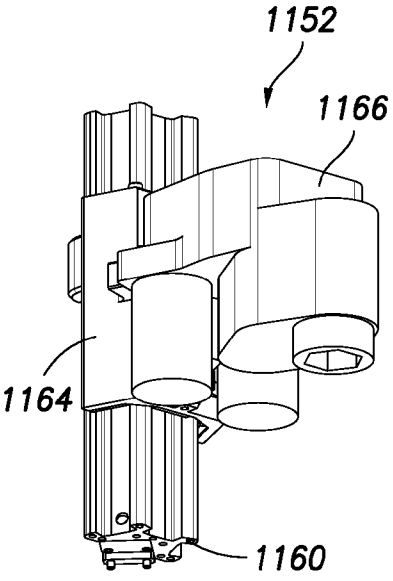
Figure 12A:
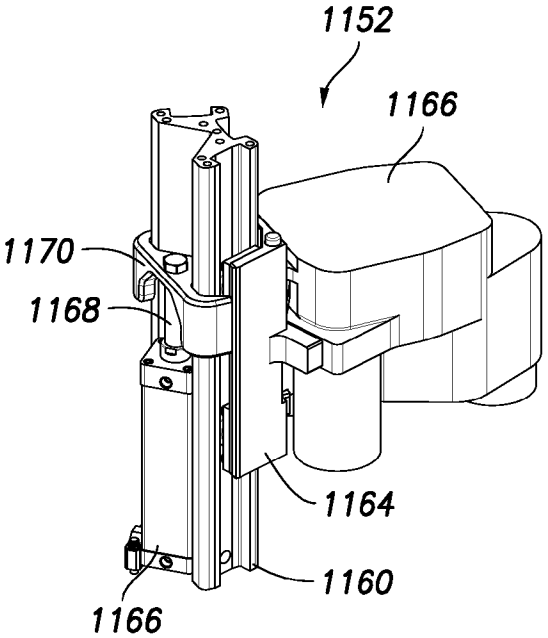
Figure 13C:
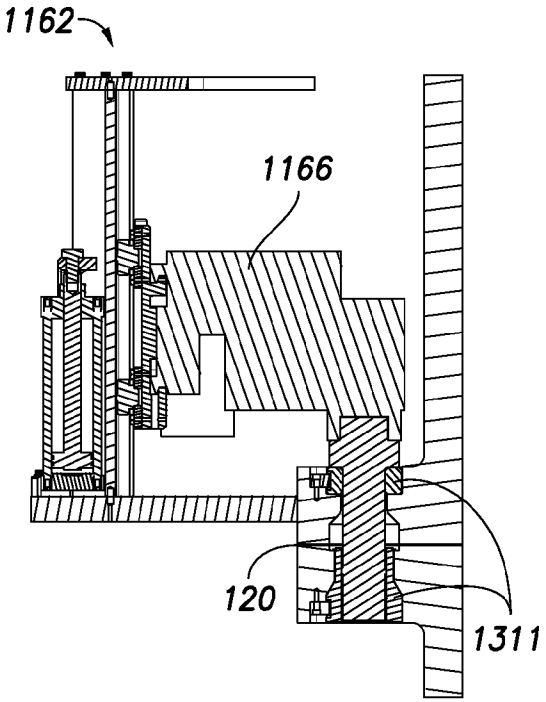
FIGS. 13A-13C are schematic cross-sectional views of the drive mechanism in various positions for connecting the adjacent tubulars with a connector.
Figure 13B:
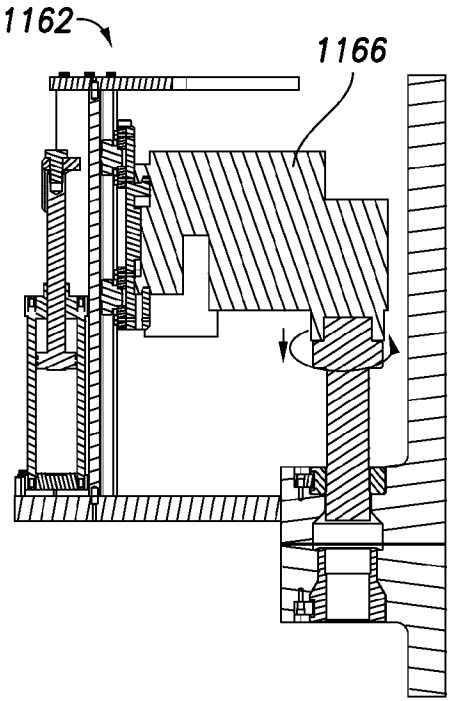
Figure 13A:
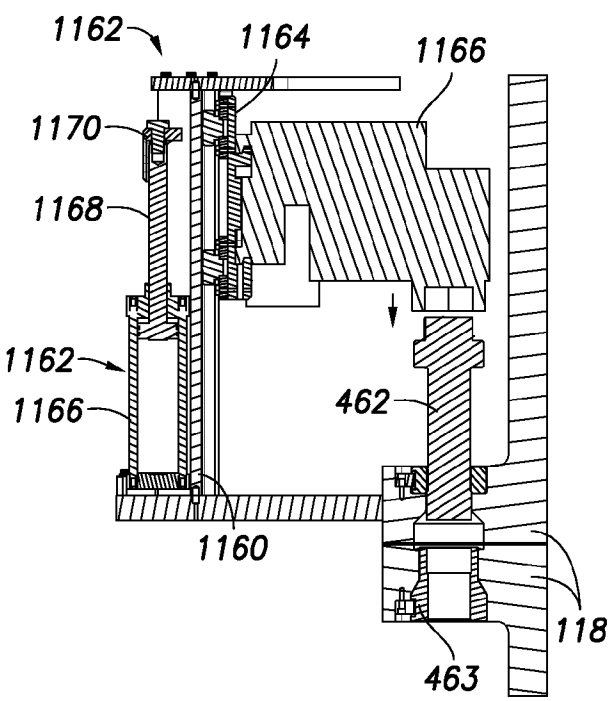

FIGS. 11A-11C show perspective views and FIGS. 13A-13C show a vertical cross-sectional view of the drive mechanism 1162 in a disengaged, an engaged, and a connected position, respectively, during operation. The positions of FIGS. 11A-11C and 13A-13C may be depicted after the drive mechanism 1162 has been positioned about the connectors using, for example, the carriers and clam assemblies described herein.

In the disengaged position of FIGS. 11A and 13A, the piston 1162 is extended and the rotational driver 1166 is positioned in alignment with the connector 462 a distance thereabove. In the engaged position of FIGS. 11A and 13B, the piston 1162 is partially retracted and the piston bracket 1170 and the rail bracket 1164 move the rotational driver 1166 downward along the rails 1160 to engage the connector 462. As the piston 1162 retracts, the piston bracket 1170 and the rail bracket 1164 move the rotational driver 1166 downward along the rails 1160 to engage the connector 462.

In the connected position of FIGS. 11A and 13C, the piston 1162 is fully retracted and the rotational driver 1166 is moved downward along the rails 1160 by the piston bracket 1170 and rail bracket 1164. As the rotational driver 1166 is moved towards the connected position, the connector 462 may be rotated by the rotational driver 1166 and advanced through the adjacent tubulars 118 to form the connection 120 therebetween.

As also shown in FIGS. 13A and 13B, the tubulars 118 may be threaded and/or contain a retained nut 1311 with threads to threadedly engage the connectors 462. For example, the tubulars 118 may contain a threaded collar to hold the connector during disconnection (e.g., for storage purposes). The connectors 462 may have mated threads to threadedly engage the threads of the tubulars 108 and/or nuts 1311 therein. Example connectors 462 may be bolts having pre-loads with torque values between 5,000 to 15,000 ft-lbs (6779.09 N-m to 20,337.27 N-M). The drive mechanisms 1162 and/or rotational drivers 1166 may be configured to facilitate connection with the connectors 462.

Figure 14:
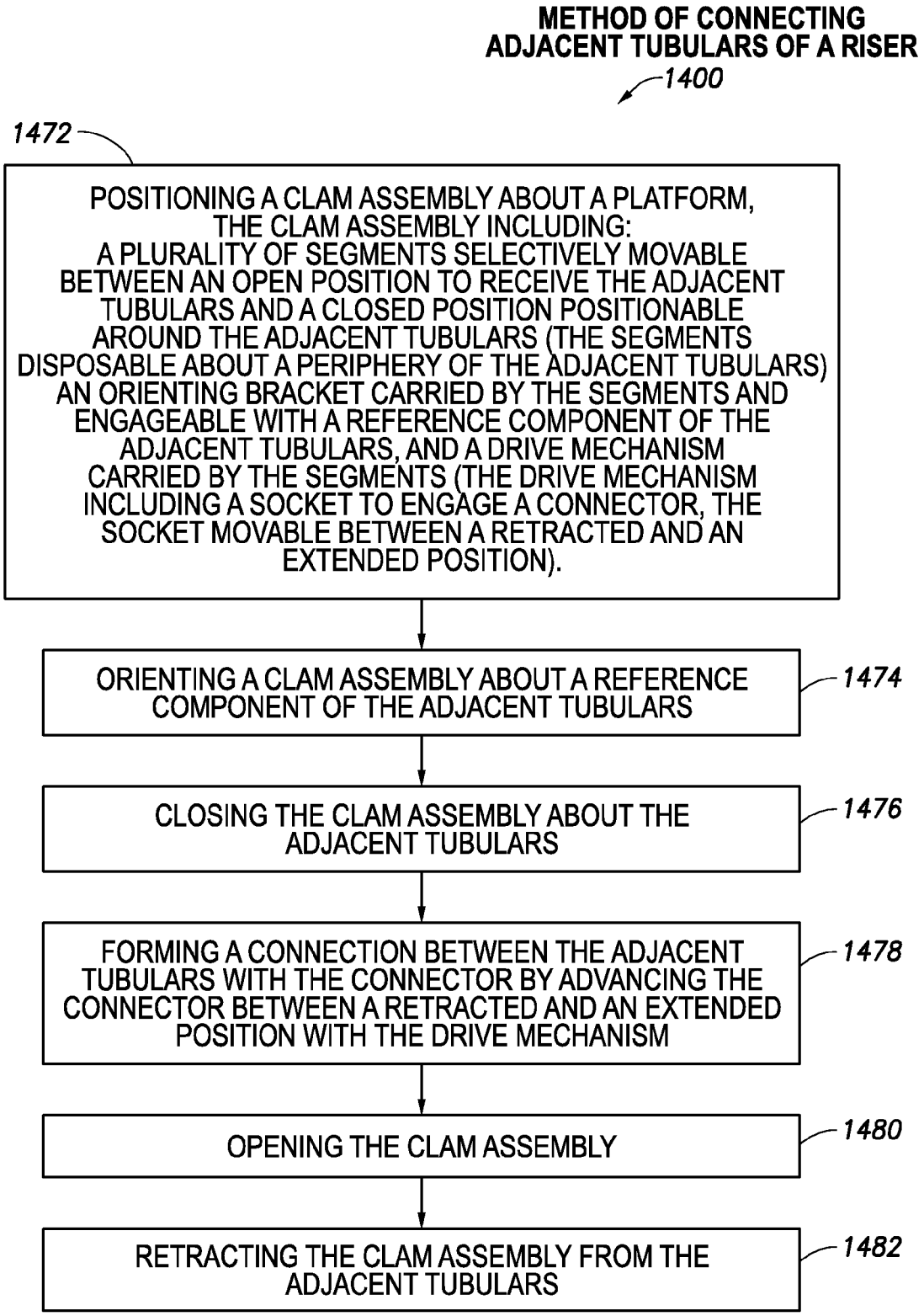
FIG. 14 is a flow chart depicting a method of connecting adjacent tubulars of a riser.

FIG. 14 is a flow chart depicting a method 1400 of connecting adjacent tubulars of a riser. The method 1400 involves positioning 1472 a clam assembly about a platform, The clam assembly includes a plurality of segments selectively movable between an open position to receive the adjacent tubulars and a closed position positionable around the adjacent tubulars (the segments disposable about a periphery of the adjacent tubulars), an orienting bracket carried by the segments and engageable with a reference component of the adjacent tubulars, and a driver carried by the segments, the drive mechanism including a socket to engage the connector (the drive mechanism movable between a retracted and an extended position).

The method further involves 1474—orienting a clam assembly about a reference component of the adjacent tubulars, 1476—closing the clam assembly about the adjacent tubulars, and 1478—forming a connection between the adjacent tubulars with the connector by advancing the connector between a retracted and an extended position with the drive mechanism. The method may also involve 1480—opening the clam assembly and 1482—retracting the clam assembly from the adjacent tubulars.

The steps may be performed in any order, and repeated as desired.

Rotational Driver

A rotational driver carried by an oilfield connection assembly for connecting adjacent tubulars, such as tubulars forming a riser extending between a platform and subsea equipment of a wellbore, is provided. The rotational driver may be configured for carrying by a carrier for placement about the adjacent tubulars. The rotational driver may receivingly engage a connector, such as a bolt, and advance the connector through adjacent tubulars to form a connection therebetween. The rotational driver may have, for example, a gearbox or a ratchet configuration.

1. Gearbox Configuration

The gearbox configuration uses motor driven gears to rotate the connector as the rotational driver is axially moved. The rotational driver may be reversible to provide installation and removal of the connectors without requiring a change of equipment. The gears may be provided in a stacked, compact gearbox configuration to transfer torque from the motors to the connector. The gearbox configuration may be used to provide for reversibility, durability, simple controls, compact design, reduced peak loading, variable teach loading, etc.

Figure 15A:
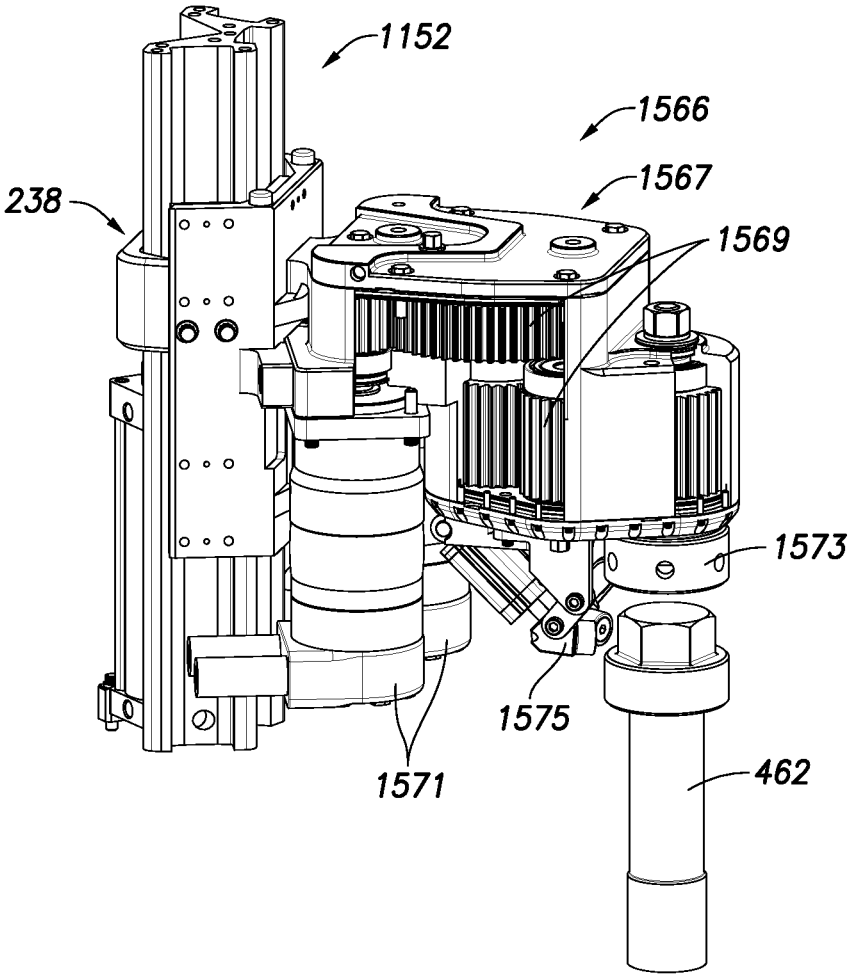
FIGS. 15A-15C are perspective, cross-sectional, and exploded views, respectively, of a gearbox drive assembly carried by a carrier and positioned about a connector.

FIGS. 15A-20 show various views of a gearbox configuration of a rotational driver 1566. FIGS. 15A-15C show perspective, cross-sectional, and exploded views, respectively, of the rotational driver 1566. One or more of the rotational driver 1566 may be carried by a carrier, such as clam assembly 238 of FIGS. 2A-8B. The rotational drivers are positionable for driving the connectors 462 in holes 463 to connect tubulars 118 of a riser 106. The rotational driver 1566 includes a gearbox 1567, gears 1569, motors 1571, a socket 1573, and a retainer 1575.

The gearbox 1567 may be provided with a handle, box bracket or other device for supporting and/or carrying the rotational driver 1566 during operation. As shown, the gearbox 1567 is operatively connectable to the axial rail 1160 of the clam assembly 238 by the rail bracket 1164. The gearbox 1567 may be sized to fit compact spaces about the clam assembly 238 and/or the tubulars 118 for connection. The gearbox 1567 has the gears 1569 therein rotationally driven by motors 1571. The motors 1571 may be, for example, one or more motors operatively connected to a power source for selectively activating portions of the drive assembly 1566. The gearbox 1567 may be made of a deflectable material, such as aluminum, that may deflect under load to compensate for positional tolerances.

The gears 1569*a-f* are coupled to the socket 1573 for rotation thereof. The socket 1573 may have an inlet for receiving a head of the connector 462. The socket 1573 may be, for example, a wrench socket for receivingly engaging a hex head of a bolt. Rotation of the socket 1573 may be used to rotate the connector 462 as the rotational driver 1566 is advanced, thereby extending the connector 462 through threaded holes 463 in the tubulars 118. Optionally, nuts 1561 may be positioned in holes 463 the tubulars 118 to facilitate connection with connector 462. The retainer 1575 may optionally be provided to secure the connector 462 in the socket 1573.

Figure 16A:
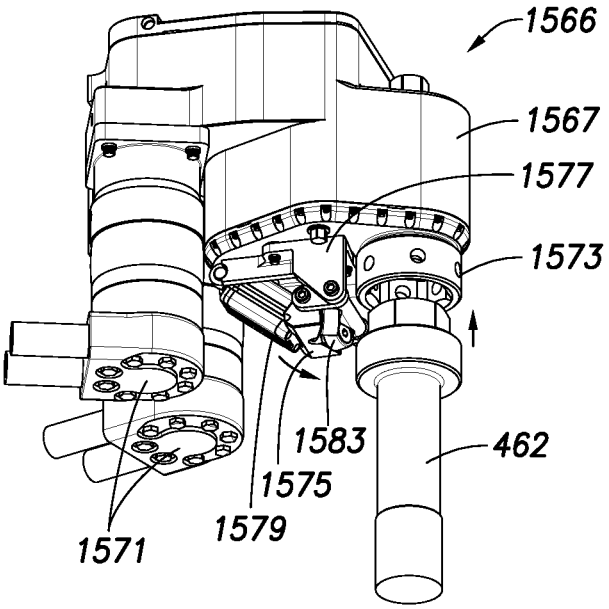
FIGS. 16A and 16B are perspective views of the gearbox drive assembly of FIG. 15A in the disengaged and engaged positions, respectively, about the connector.
Figure 16B:
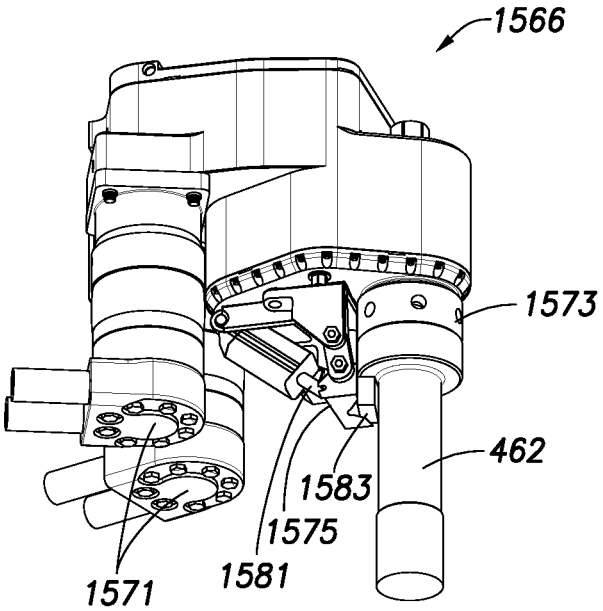

FIGS. 16A and 16B depict operation of the retainer 1575. These figures show bottom perspective views of the rotational driver 1566 before and after engagement, respectively, with the connector 462. As shown in these views, the retainer 1575 may include a retainer bracket 1577, a cylinder 1579, a piston 1581, and a wedge 1583. The retainer bracket 1575 is operatively connectable to the gearbox 1567. The cylinder 1579 is supported by the retainer bracket 1575 with the piston 1581 extendable therefrom. The wedge 1583 is positioned on an end of the piston 1581.

The retainer bracket 1575 includes a base with a pivoting end operatively connected to the wedge 1583. As the piston 1581 extends and retracts, the pivoting end rotates to selectively extend and retract the wedge 1583. The wedge 1583 is movable by the piston 1581 and retainer bracket 1577 between a retracted position away from the connector 462 and an extended position in engagement with the connector 462. As shown, the connector 462 is a bolt with a shoulder to receivingly engage the wedge 1583. In the extended position, the wedge 1583 pinches a head of the connector 1583 against the socket 1573 thereby retaining the connector 462 in the socket 1573 of the rotational driver 1566.

Figure 15B:
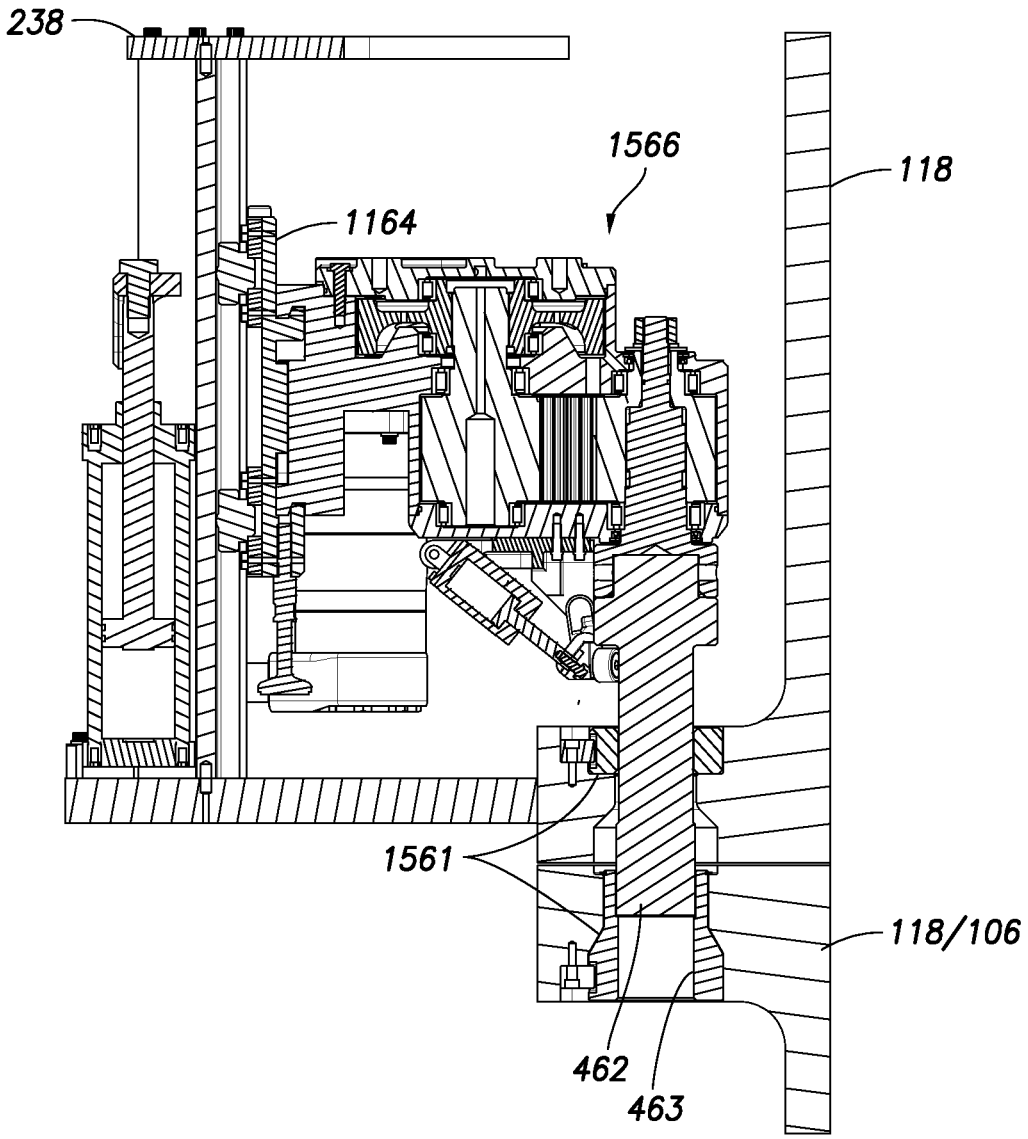
Figure 15C:
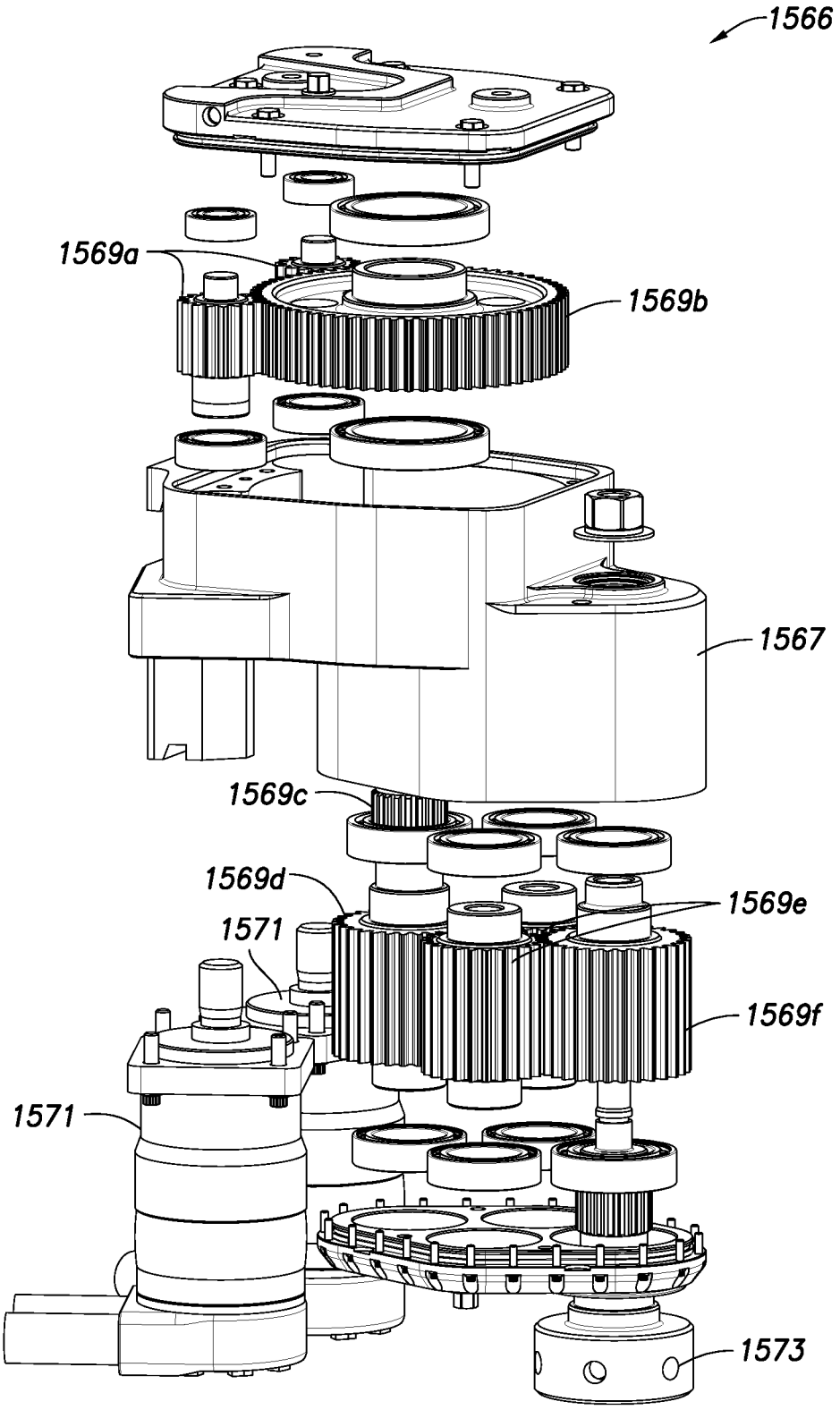

The retainer 1575 may be used to lift and lower the connector 462. The lifting may be performed gently so as not to damage threads and/or nuts 1561 in the tubular 118 (FIG. 15B). The retainer 1575 may be pneumatically or hydraulically actuated by the motors 1571.

The rotational driver 1566 may be provided with other components, such as directional control valves and position sensors to monitor the connection process, determine when to active the motors 1571, and indicate a direction of rotation for the gears 1569*a-f*. Guided positioning of the rotational driver 1566 may be provided using, for example, the clam assembly 238 and/or the carrier 236. For example, a proximity sensor may be provided about teeth of the gears 1569 to measure rotation.

The rotational driver 1566 may be manually and/or automatically operated. The control room 124 or other surface equipment 110 (FIG. 1B) may be provided with processing and/or control units for collecting data, performing analysis, sending control signals, and generating reports (e.g., control curve plots). The surface equipment 110 may be used, for example, to provide real time feedback for automatic or manual operation and/or adjustment. For example, where multiple drive assemblies 1566 may be provided about the tubulars 118, multiple connectors 462 may be engaged to connect multiple tubulars 118 (see, e.g., FIG. 15B). Simultaneous, automatic connections 120 may be provided based on real time data.

Figure 17:
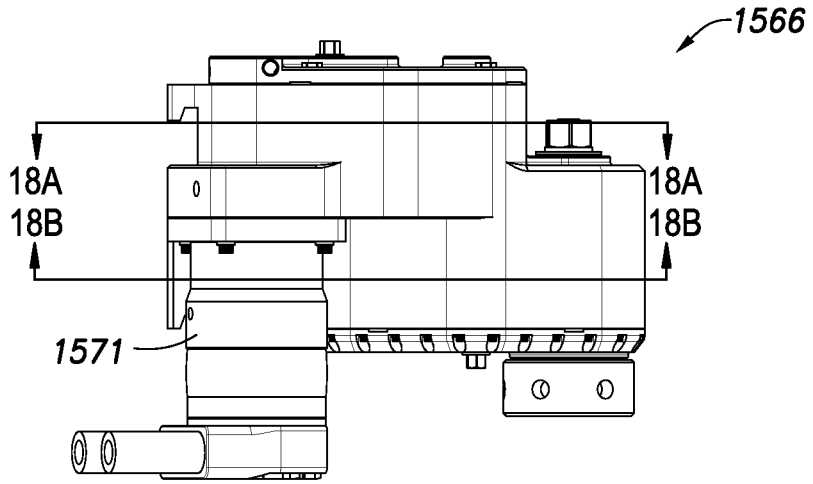
FIG. 17 is a side view of the gearbox drive assembly.
Figure 18A:
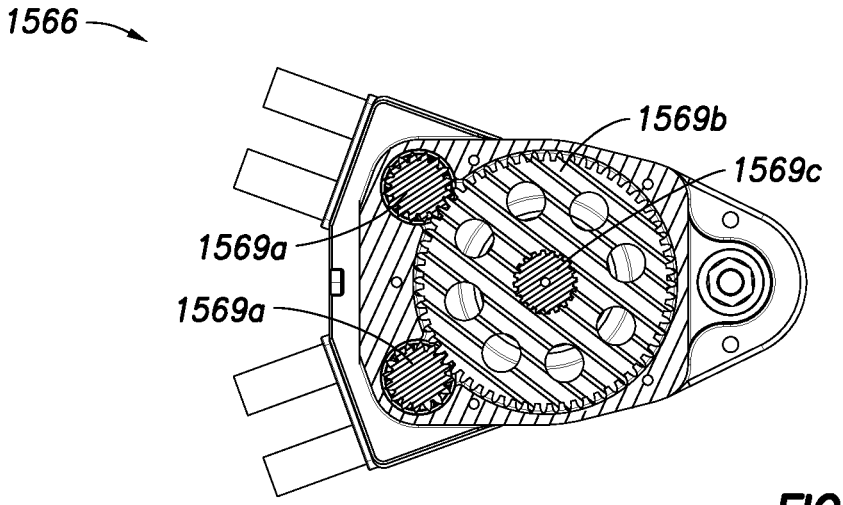
FIGS. 18A and 18B are cross-sectional views of the gearbox drive assembly of FIG. 17 taken along lines 18A-18A and 18B-18B, respectively.
Figure 18B:
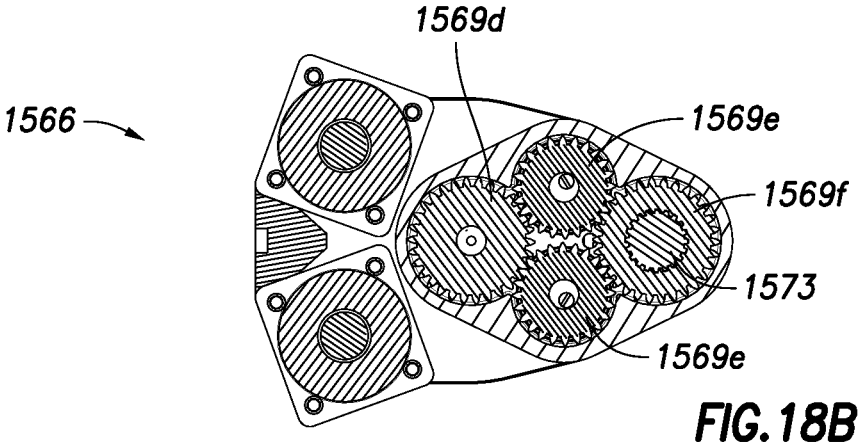
Figure 19:
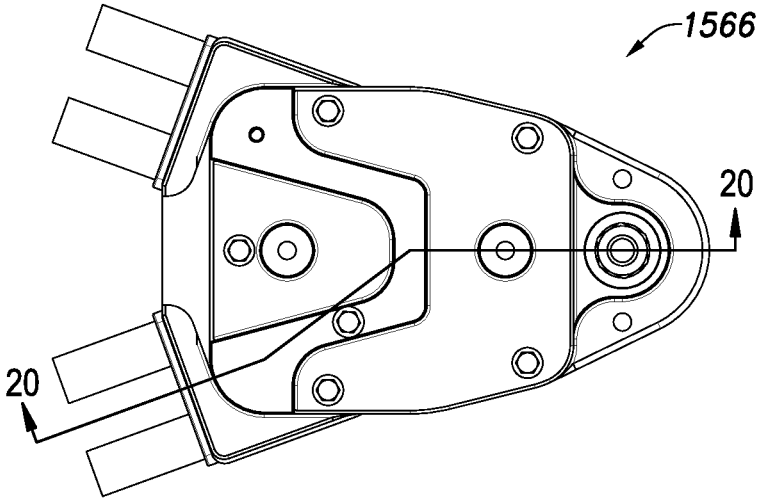
FIG. 19 is a top view of the gearbox drive assembly of FIG. 17.
Figure 20:
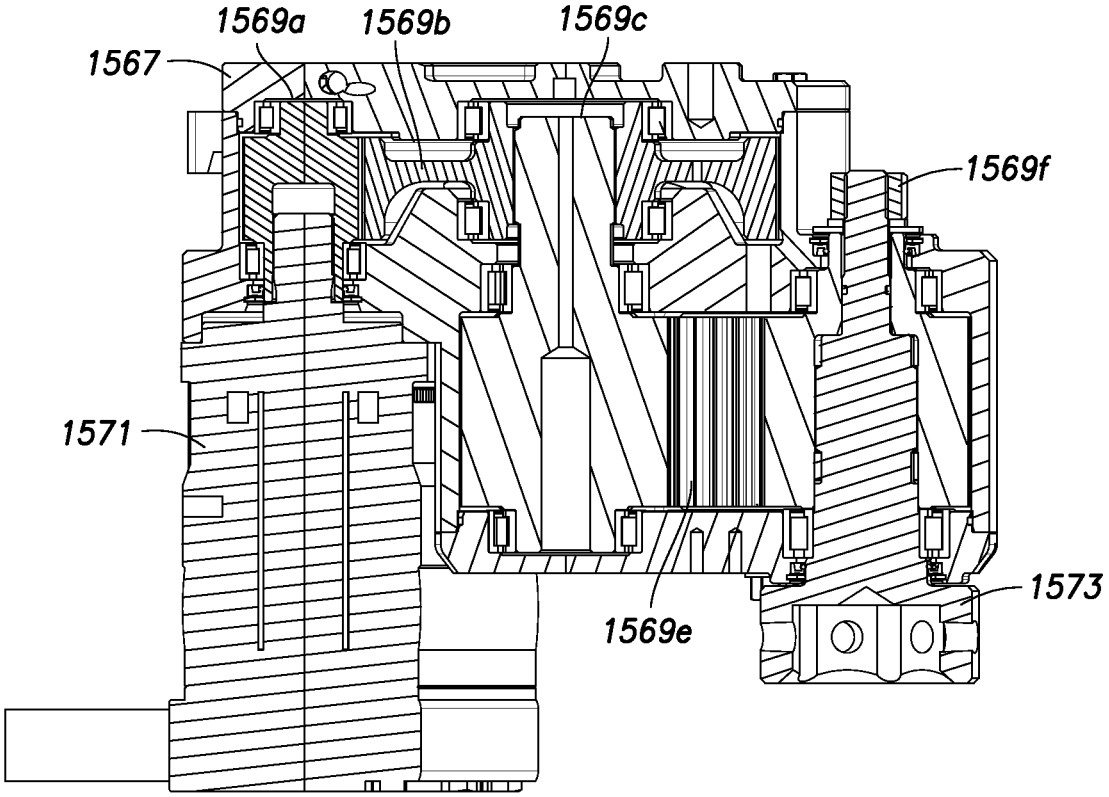
FIG. 20 is a cross-sectional view of the gearbox drive assembly of FIG. 19 taken along line 19-19.

FIGS. 17-20 show additional views depicting operation of the gears 1569*a-f*. FIG. 17 shows a side view of the rotational driver 1566. FIGS. 18A and 18B are cross-sectional views of the rotational driver 1566 taken along lines 18A-18A and 18B-18B, respectively. FIG. 19 is a top view of the rotational driver 1566. FIG. 20 is a cross-sectional view of the rotational driver 1566 of FIG. 19 taken along line 20-20. As shown in these views, the gears include a pair of pinion gears 1569*a* operatively coupled to the motors 1571 for rotation thereby.

The pinion gears 1569*a* drive a drive gear 1569*b*. The drive gear 1569*b* has a drive shaft 1569*c* therein rotated by the drive gear 1569*b*. The driver shaft 1569*c* has a drive end 1569*d* connected thereto and rotated therewith. The drive end 1569*d* rotates intermediate gears 1569*e*. The intermediate gears 1569*e* are coupled to a socket gear 1569*f* for transferring rotation from the secondary gear 1569*e* to the socket gear 1569*f*. The socket gear 1569*f* is coupled to the socket 1573 to transfer rotation from the secondary gear 1569*e* thereto. The intermediate gears 1569*e* have teeth 1565 interlockingly engaging teeth of the socket gear 1569*f*. Multiple intermediate gears 1569*e* may be used to provide multiple points of engagement with the socket gear 1569*f*.

Each pinion gear 1569*a* may be connected to one of the motors 1571. One or more pinion gears 1569*a* and one or more motors 1571 may be used. The motors 1571 may be low speed/high torque hydraulic drive motors capable of turning the pinion gears 1569*a*, and the drive gear 1569*b* meshed with the pinion gears 1569*a*. A first of the motors 1571 may be used to drive the gears 1569*a-f* during the initial rotation of the connectors 462. The first motor 1571 may thread or unthread the connector 462 under high flow, low hydraulic pressure. Once the connector 462 is seated in the tubulars 118, a second of the motors 1571 may be utilized in parallel with the first motor 1571, both operating with low flow, high hydraulic pressure to tighten the connector 462 in place in the tubulars 118. The operation may be reversed to break the connector 462 away from the tubulars 118 and/or to retract the connector 462 from the tubulars.

The gears 1569 may be provided with a gear ratio to facilitate the transfer of torque while minimizing the effects of loads and/or stresses on the drive assembly 1566. The pinion gears 1569*a* may be meshed with the drive gear 1569*b* to amplify torque as needed. The drive gear 1569*b* may have a larger diameter than the pinion and intermediate gears 1569*a,d* to transfer torque as needed. The various gears 1569, as shown, may be stacked to reduce spacing and thereby the overall size of the gearbox 2567. The stacked gears 1569 may be configured to drive connectors 462 in a location where head room may be limited.

Torque from the motors 1571 may be multiplied within reduced space by to the gears 1569 and transferred into a narrow envelope within the gearbox 1567 by loading multiple teeth of the intermediate gears 1569*e* simultaneously on the socket gear 1569*f*. One or more of the intermediate gears 1569*e* may be provided to transfer torque to the socket gear 1569*f*. In the example shown, two intermediate gears 1569*e* are used to provide multiple contact points for transferring torque. In such cases, at least two gear teeth may be loaded simultaneously to reduce tooth bending stress on the gears 1569.

2. Ratchet Configuration

The ratchet configuration may be used to drive the connectors of the tubulars. The ratchet configuration employs a ratchet to rotate the connector as the rotational driver is axially moved. The rotational driver includes a pawl housing rotatable about a ratchet support by a ratchet motor and gears, and a pawl extendable from the ratchet housing to engage a socket and rotate the connector. The pawl may have multiple teeth engageable with the socket to disperse load therealong. The ratchet configuration may be used to provide for reversibility, durability, simple controls, compact design, reduced peak loading, variable teach loading, etc.

Figure 21A:
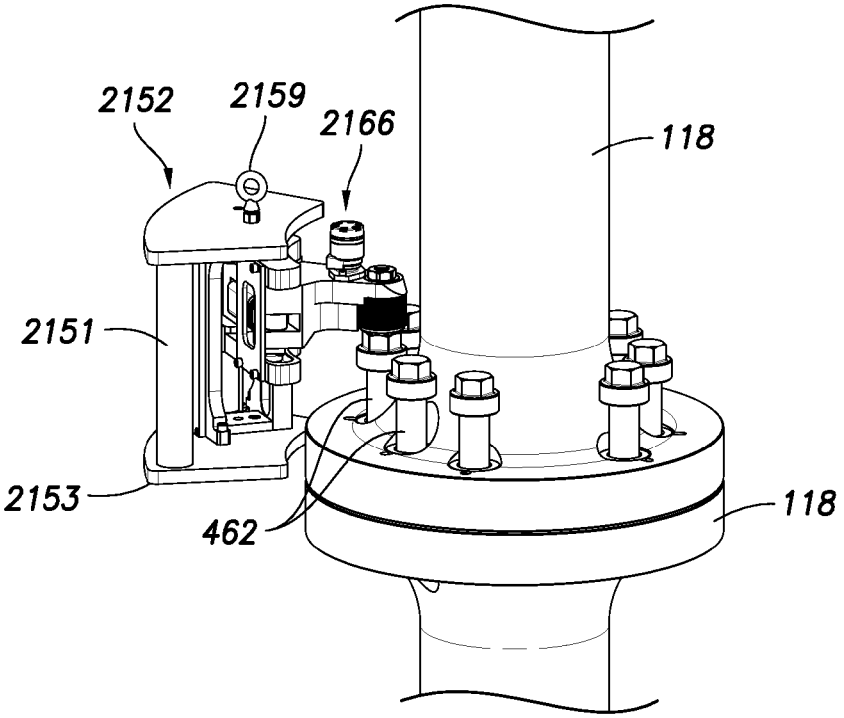
FIGS. 21A and 21B are perspective views of a ratchet drive assembly in a disengaged and an engaged position, respectively, about the connector of adjacent tubulars.
Figure 21B:
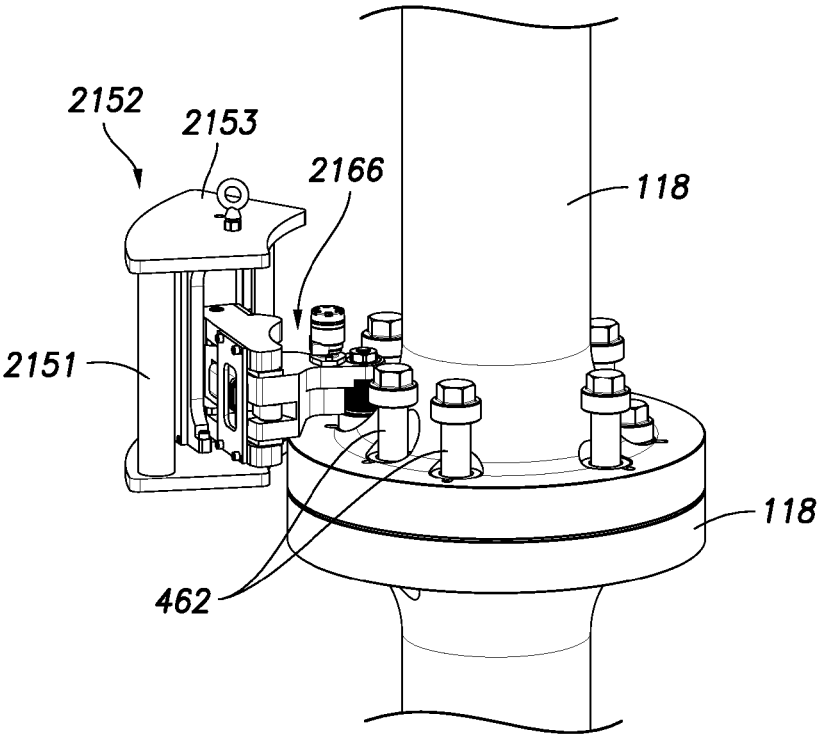
Figure 22A:
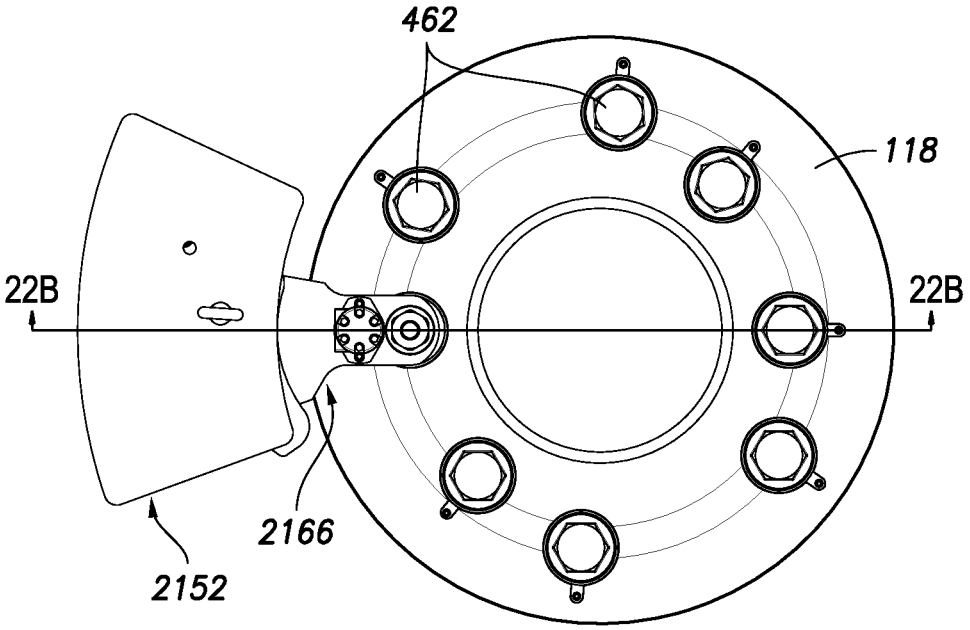
FIGS. 22A and 22B are top and cross-sectional views of the ratchet drive assembly positioned about the connector of adjacent tubulars.
Figure 22B:
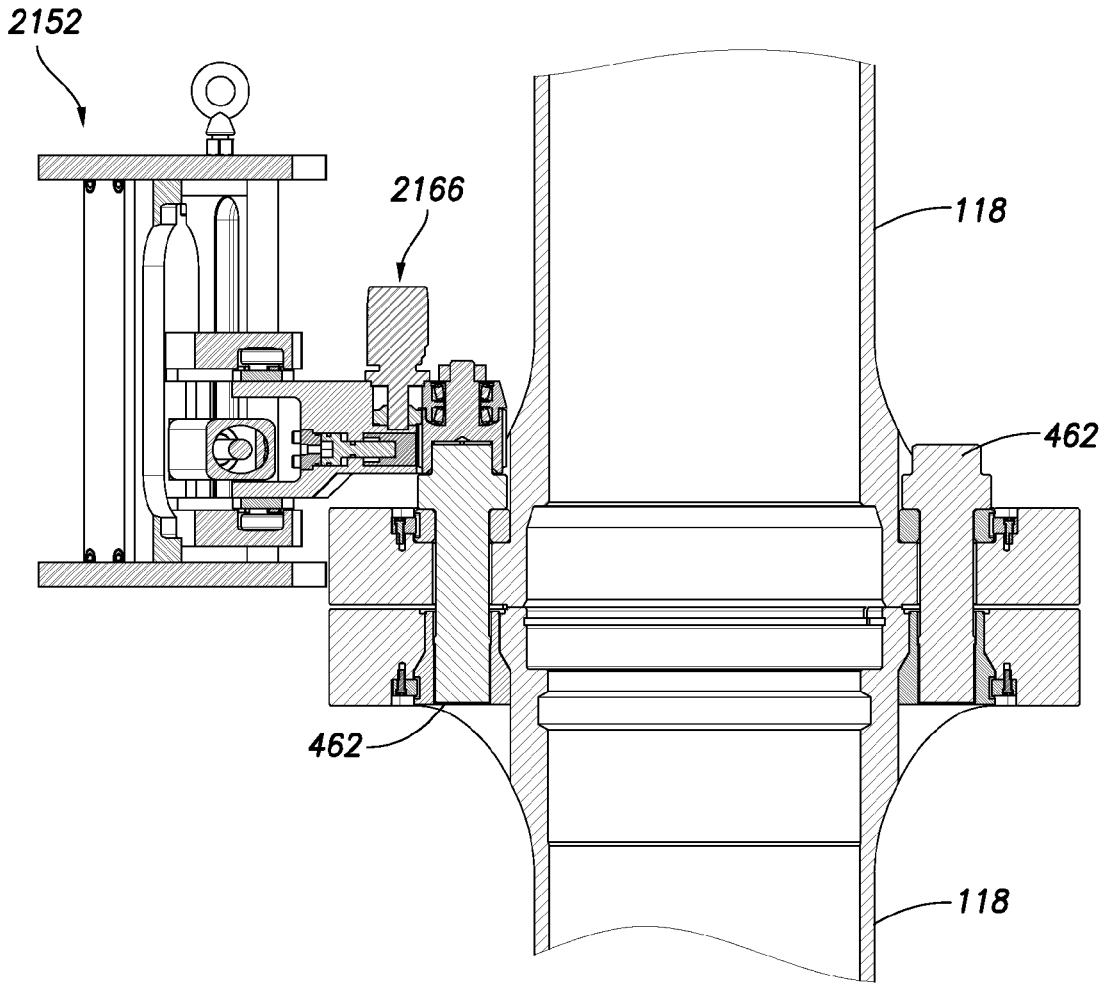
Figure 23A:
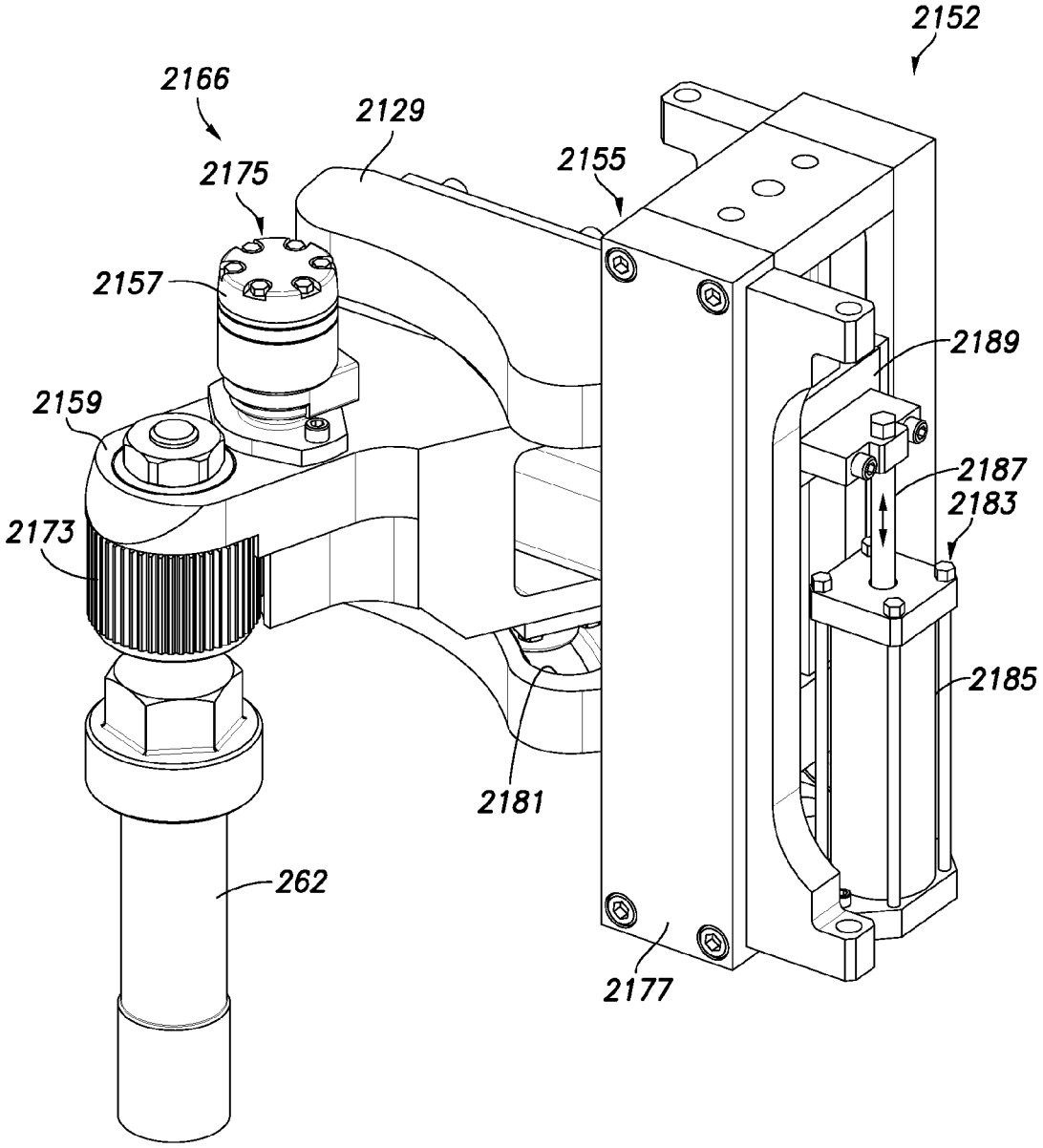
FIGS. 23A and 23B are perspective and exploded views, respectively, of the ratchet drive assembly.
Figure 23B:
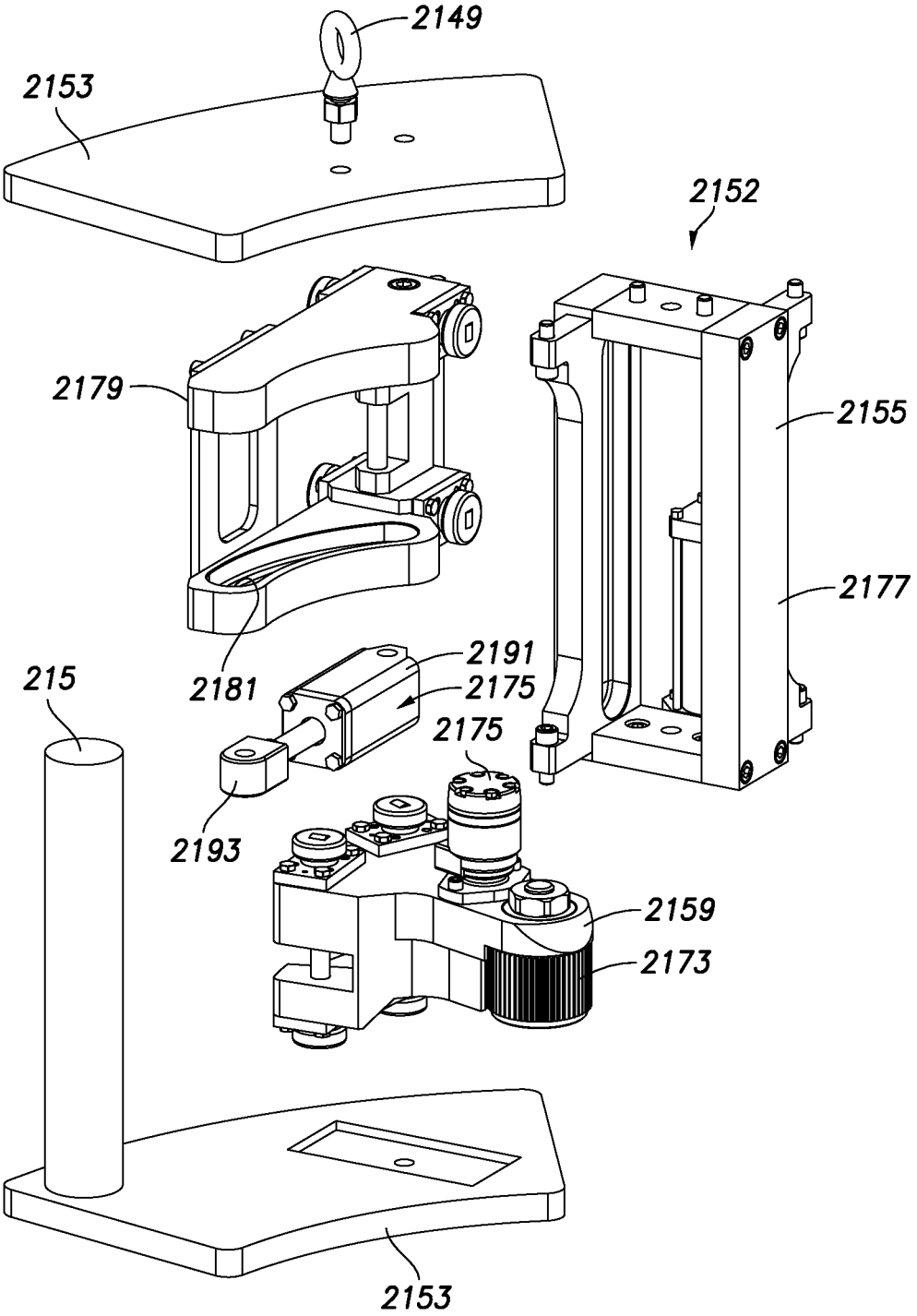

FIGS. 21A-25B show the ratchet configuration of a drive mechanism 2152 and a rotational driver 2166 in position about adjacent tubulars 118 and driving a connector 462 therethrough. FIGS. 21A and 21B shows the ratchet configuration in a retracted and an extended position, respectively. FIG. 22A shows a top view of the drive mechanism 2152, rotational driver 2166 in the extended position of FIG. 21B. FIG. 22B shows a cross-sectional view of FIG. 22A taken along line 22B-22B. FIGS. 23A and 23B show perspective and exploded views of the rotational driver 2166 coupled to a drive mechanism 2152.

The drive mechanism 2152 may be a device for axially positioning the rotational driver 2166, such as those described herein (e.g., drive mechanism 1152 of FIGS. 11A-11B). The drive mechanism 2152 may be carried manually and/or by a clam assembly and/or carrier as described herein. The drive mechanism 2152 may include upper and lower drive plates 2153 connected by supports 2151. Rotational driver 2166 may be supported between the drive plates 2153. Optionally, a hook 2149 may be provided on the drive plate for carrying the drive mechanism 2152 and/or rotational driver 2166.

The rotational driver 2166 includes a ratchet support 2155, a pawl housing 2159, a ratchet actuator 2175, and a socket 2173. The ratchet support 2155 is operatively connectable to the drive plates 2153 with the pawl housing 2159 movable thereabout via movement of the ratchet actuator 2175. The ratchet support 2155 may include a ratchet base 2177 with a ratchet arms 2179 extending therefrom. A slot 2181 extends through at least one of the ratchet arms 2179. The ratchet support 2155 and arms 2179 movably support the pawl housing 2159 in the slot 2181.

The ratchet support 2155 may be operatively connected to or integral with an axial driver 2183. As shown, the axial driver 2183 includes a ratchet cylinder 2185 with a ratchet piston 2187 and a piston bracket 2189. The piston bracket 2189 is operatively connected to or integral with the ratchet support 2155. The ratchet support 2155, and, therefore, the rotational driver 2166, are axially movable along the ratchet support 2155 by movement of the ratchet piston 2187.

The pawl housing 2159 has a pawl pocket 2189 for slidingly receiving the pawl 2169. The ratchet actuator 2175 includes an actuator cylinder 2191 operatively connecting the pawl housing 2159 to the ratchet support 2155. The actuator cylinder 2191 is operatively connected to the ratchet support 2155 and has an actuator piston 2193 extending therefrom. The actuator piston 2193 has an actuator end operatively connectable to the pawl housing.

Figure 24:
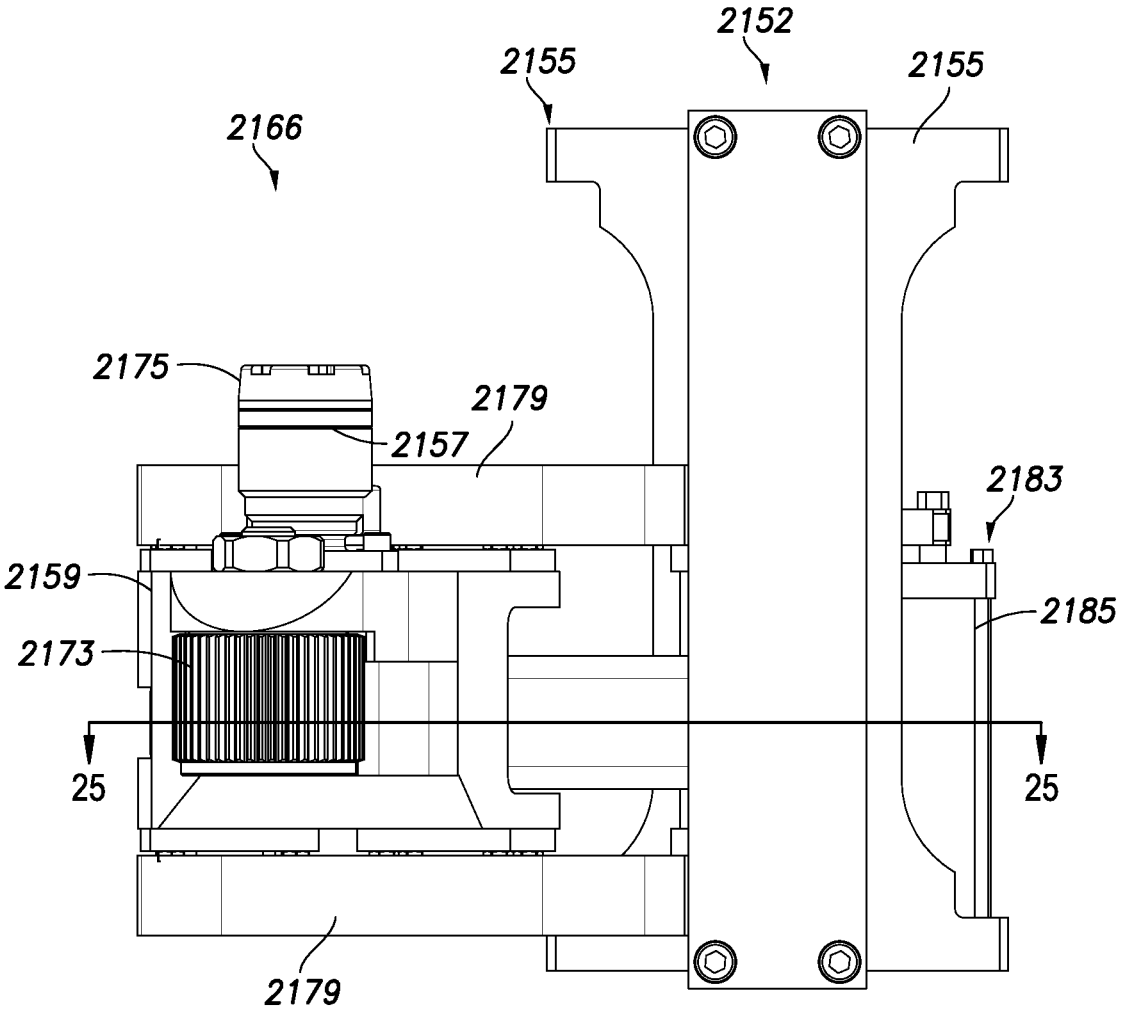
FIG. 24 is a side view of the alternate drive assembly of FIG. 23A.
Figure 25A:
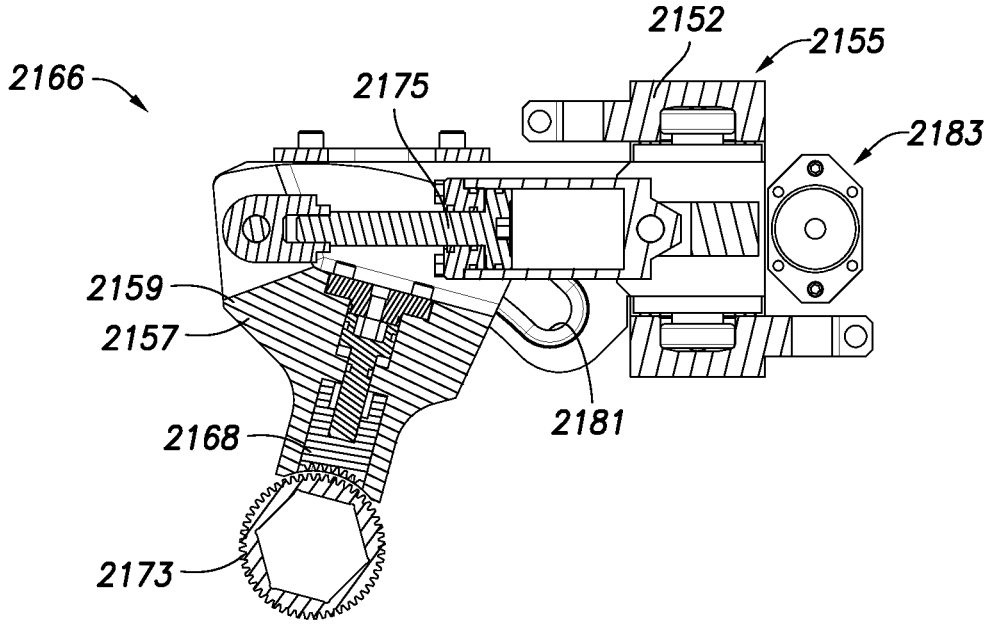
FIGS. 25A and 25B are cross-sectional views of the alternate drive assembly of FIG. 24 taken along line 25-25 in the extended and retracted positions, respectively.
Figure 25B:
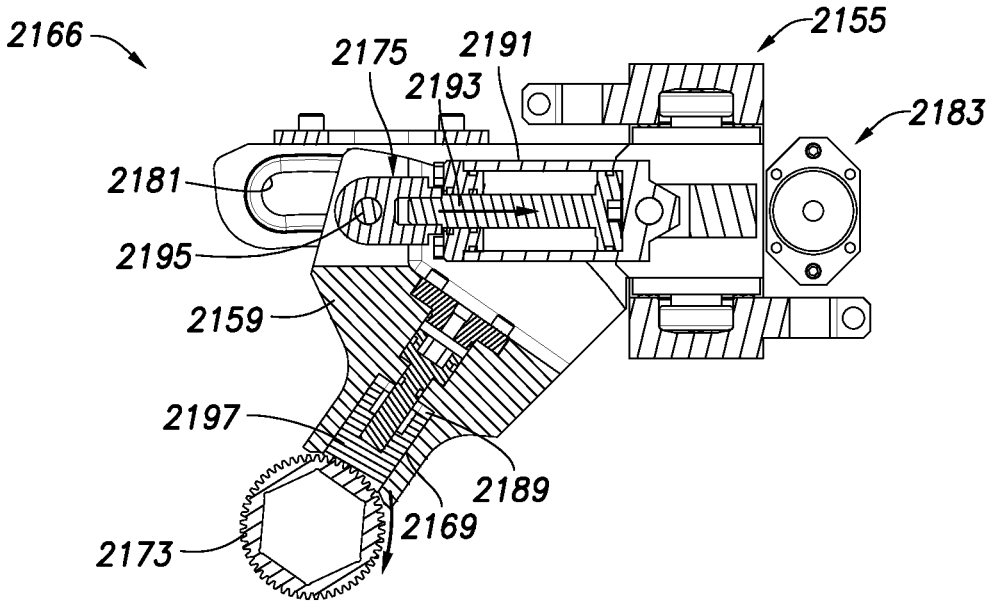

FIG. 24 shows a side view of the drive mechanism 2152 and the rotational driver 2166. FIGS. 25A and 25B show a cross-sectional view of the drive mechanism 2152 and rotational driver 2166 in the retracted and extended positions, respectively. Extension and retraction of the actuator piston 2193 permits pivotal and/or sliding movement of the pawl housing 2159 along the slot 2181 in the ratchet support 2155. The pawl housing 2159 has a guide 2195 extending therethrough and receivably engageable with the slot 2181 of the ratchet support 2155. The guide 2195 and slot 2181 interact to define a path of travel for the pawl housing 2159. As shown, the slot 2181 is curved to provide for translation and rotation of the pawl housing 2159 along a predetermined path between the retracted position of FIG. 25A and the extended position of FIG. 25B.

As shown in FIGS. 24-25B, the rotational driver 2166 also includes a pawl 2169 engageable with the socket 2173. The pawl 2169 is slidingly movable in the pawl pocket 2189 in response to pressure applied thereto. The pawl 2169 may be hydraulically activated by a hydraulic source fluidly coupled to the pawl pocket 2189. As shown in FIGS. 25A and 25B, the pawl 2169 is movable between a disengaged position of FIG. 25A to an engaged position of FIG. 25B.

The pawl 2169 has a toothed head 2197 engageable with the socket 2173. The pawl 2169 may be hydraulically activated and centrally located about a head of the connector 462. The socket 2173 may be operatively connectable to the connector 462 for rotation thereof by movement of the pawl housing 2159 and the pawl 2169. The toothed head 2197 of the pawl 2169 may be wide enough to engage multiple teeth for load distribution therebetween. The toothed head 2197 of the pawl 2169 may also be used to restrict rolling that may occur when the pawl 2169 is engaged with the socket 2173, but does not move relative to it.

Figure 26:
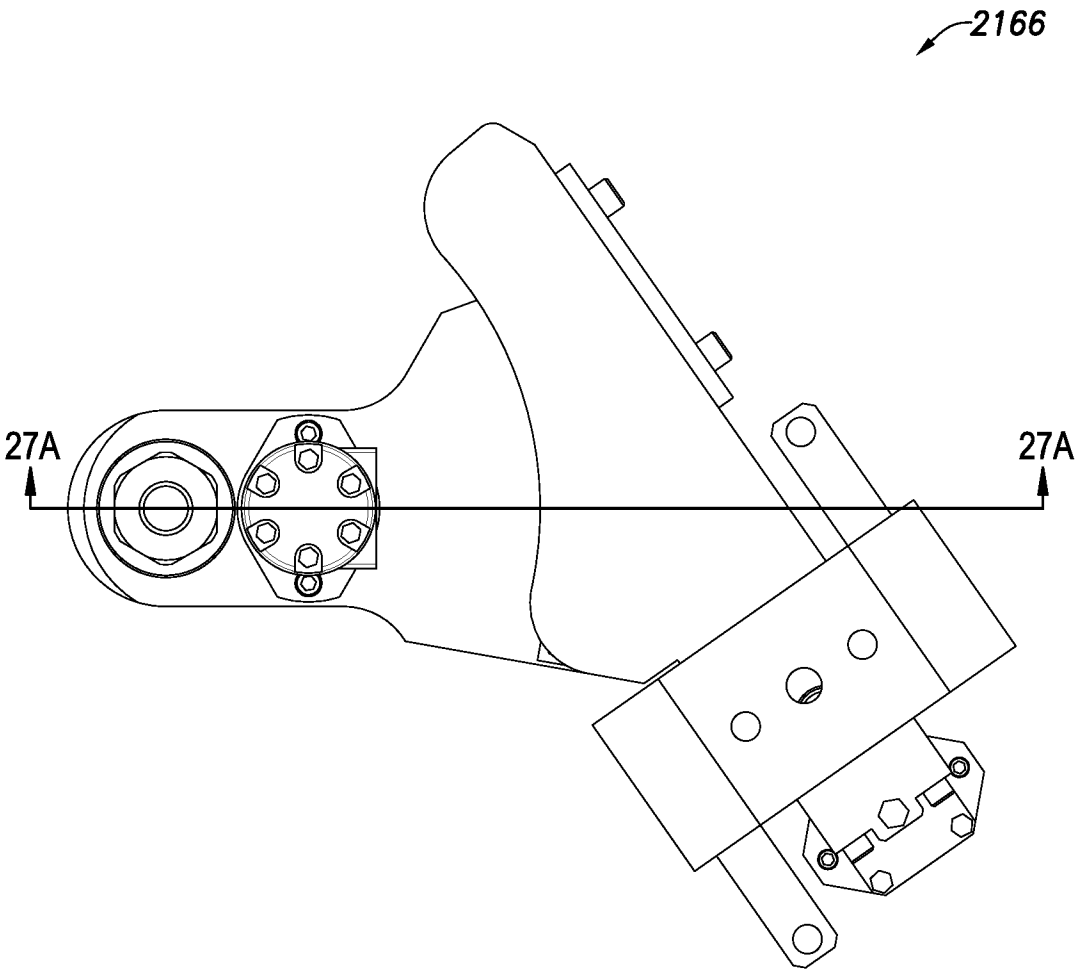
FIG. 26 is a top view of the alternate drive assembly of FIG. 23A.
Figure 27A:
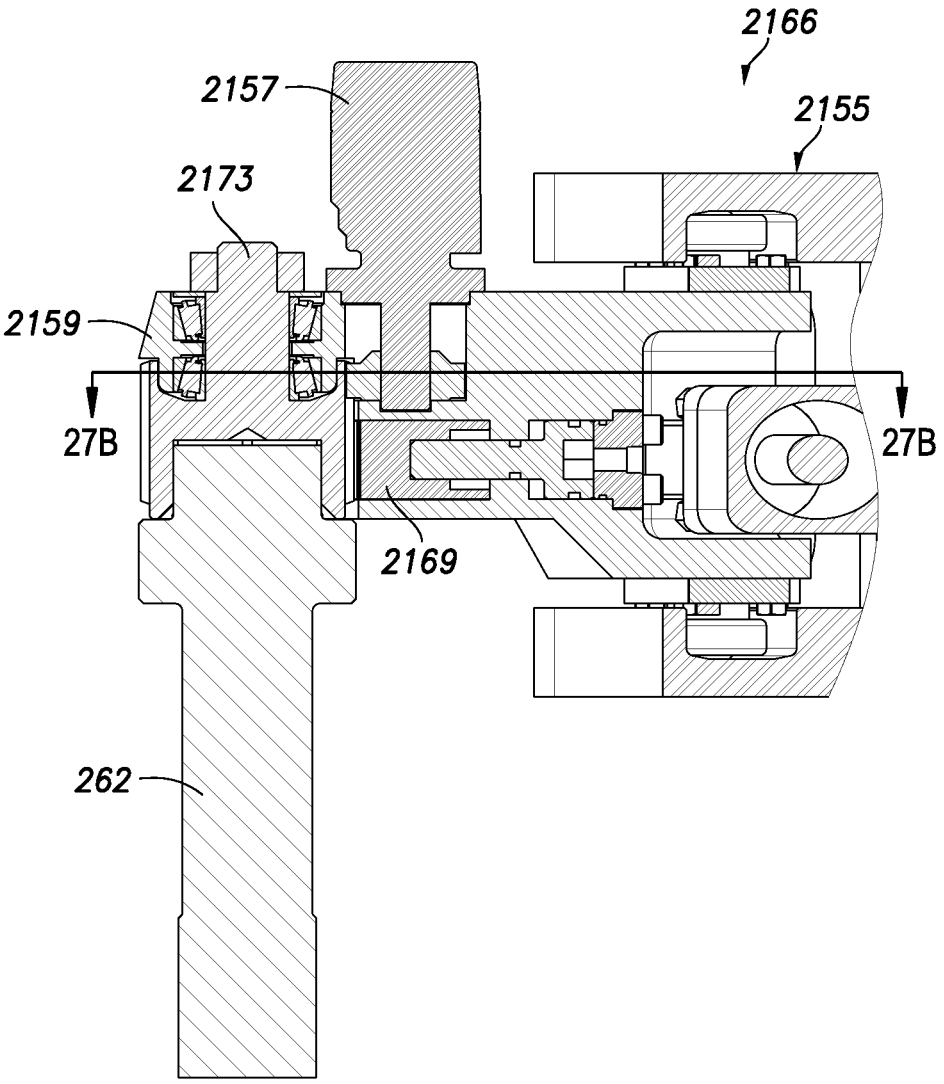
FIG. 27A is a vertical cross-sectional view of the alternate drive assembly of FIG. 26 taken along line 27A-27A.
Figure 27B:
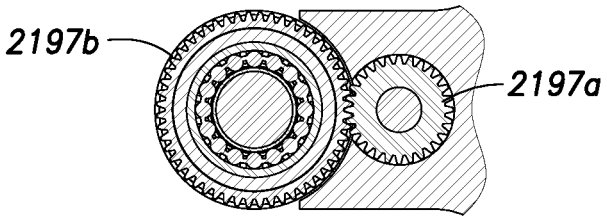
FIG. 27B is a horizontal cross-sectional view of the alternate drive assembly of FIG. 26A taken along line 27B-27B.

As shown by FIGS. 26-27B, a ratchet motor 2157 and ratchet gears 2197*a,b* may be used to drive the rotational driver 2166. The ratchet motor 2157 may be, for example, spin drive motor, directly or indirectly coupled to the socket 2173 by gears 2197*a,b*. The gears 2197*a,b* may include a motor gear 2197*a* rotationally driven by the motor 2157 and a ratchet gear 2197*b* operatively coupled between the motor 2157 and the socket 2197 for transferring movement therebetween.

While the motor 2157 is rotating to thread or unthread a bolt, the pawl 2169 is retracted. To apply final (increased) torque or to loosen (breakaway), the actuator piston 2197 applies force and leverage to the pawl housing 2159 for rotation thereof along the slot 2181. The pawl 2169 may be configured with a first piston area for torqueing down and a second piston area for breaking away (loosening). The pawl 2169 may advance the connector 462 by a tightening or loosening stroke to the pawl housing 2159, and retracted for return stroke of the pawl housing 2159. The pawl 2173 retracts and the actuator piston 2197 strokes forward at which point the pawl 2169 may re-engage for a next turn of the connector 462.

Sensors may optionally be provided about the rotational driver 2166 to detect engagement of the pawl 2169 and/or forces on the rotational driver 2166. When the pawl 2169 engages there may be times when the toothed head 2197 of the pawl 2169 contacts the socket 2173 crest to crest and thus may not properly seat. The sensors may be positioned about the actuator piston 2193 before an end of a stroke to trigger a controller to actuate the pawl 2169 prematurely to ensure teeth of the pawl 2169 and socket 2173 properly engage.

In operation, the pawl housing 2157 may be in a start position with the pawl 2169 retracted as shown in FIG. 25A. The pawl 2169 may be hydraulically activated to engage the socket 2173. Once engaged, the socket 2173, and thereby the connector 462 coupled to the socket 2173, may be rotated by movement of the pawl housing 2159 to the rotated position of FIG. 25B. The pawl housing 2159 may be selectively rotated by extension and retraction of the actuator piston 2193. The pawl 2169 may be retracted so that the motor 2157 rotates motor gear 2197*a*. The socket 2173, and the connector 462 therein, is then rotated by the rotation of the ratchet gear 2197*b* by the motor gear 2197*a*. The pawl 2169 may be extended for engagement with the socket 2173 and rotated by movement of the pawl housing 2157 to tighten the connector 462. The process may be reversed for removal of the connector.

Figure 28A:
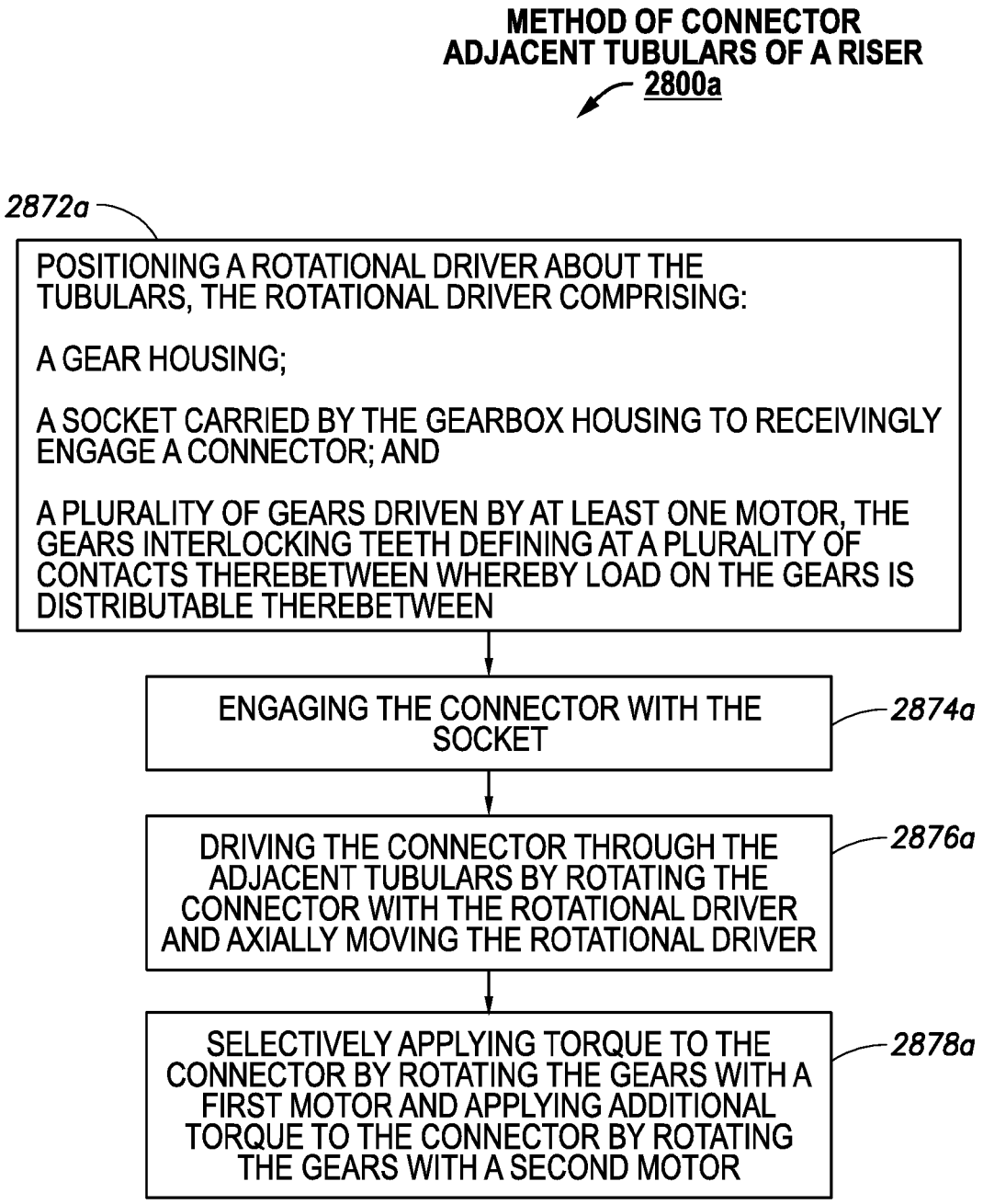
FIGS. 28A and 28B are flow charts depicting methods of connecting adjacent tubulars of a riser.
Figure 28B:
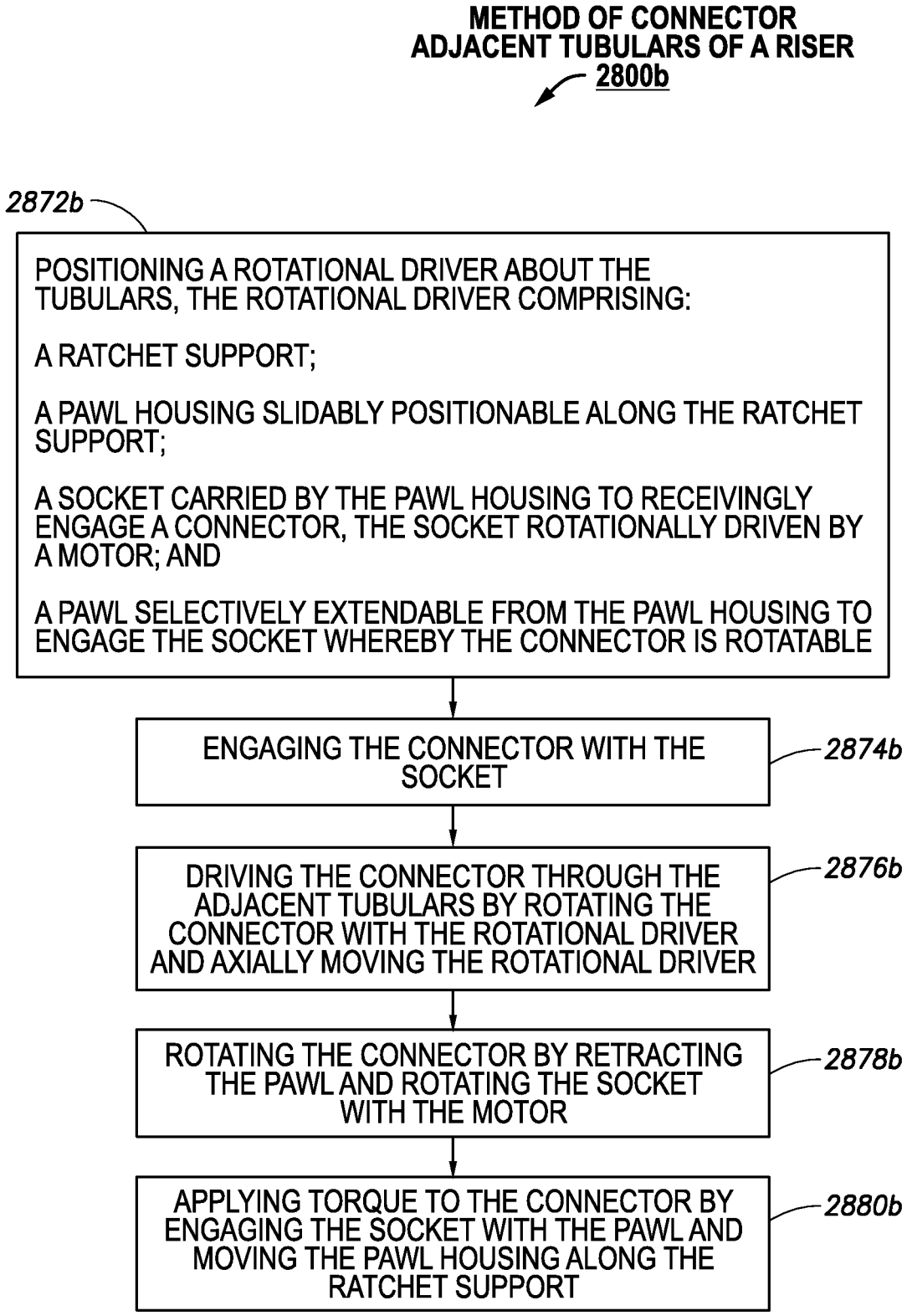

FIGS. 28A and 28B are flow charts depicting methods 2800A and 2800B of connecting adjacent tubulars of a riser. The method 2800*a* depicts a method using the gearbox configuration of FIGS. 15A-20. The method 2800*b* depicts a method using the ratchet configuration of FIGS. 21-28B.

The method 2800*a* involves positioning a rotational driver about the tubulars. The rotational driver includes a gearbox housing, a socket carried by the gearbox housing to receivingly engage a connector, and a plurality of gears driven by at least one motor, the gears interlocking teeth defining at a plurality of contacts therebetween whereby load on the gears is distributable therebetween. The method further involves 2874*a* engaging the connector with the socket, 2876*a*—driving the connector through the adjacent tubulars by rotating the connector with the rotational driver and axially moving the rotational driver, and 2878*a*—selectively applying torque to the connector by rotating the gears with a first motor and applying additional torque to the connector by rotating the gears with a second motor.

The method 2800*b* involves positioning a rotational driver about the tubulars. The rotational driver includes a ratchet support, a pawl housing slidably positionable along the ratchet support, a socket carried by the pawl housing to receivingly engage a connector, the socket rotational driven by a motor, and a pawl selectively extendable from the pawl housing to engage the socket whereby the connector is rotatable by the pawl housing. The method further involves 2874*b*—engaging the connector with the socket, 2876*b* driving the connector through the adjacent tubulars by rotating the connector with the rotational driver and axially moving the rotational driver, 2878*b*—rotating the connector by retracting the pawl and rotating the socket with the motor, and 2880*b*—applying torque to the connector by engaging the socket with the pawl and moving the pawl housing along the ratchet support.

The methods may be performed in any order, and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the subject matter may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, the clam assembly may be carried by a variety of carriers and have any number of segments and drive mechanism.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A clam assembly for connecting adjacent tubulars positionable in a wellbore of a wellsite for passing fluid through the adjacent tubulars, the clam assembly comprising:

a plurality of segments selectively movable between an open position to receive the adjacent tubulars and a closed position positionable around the adjacent tubulars, the plurality of segments disposable about a periphery of the adjacent tubulars;

at least one drive mechanism carried by the plurality of segments, each of the at least one drive mechanisms comprising a driver radially fixed to the plurality of segments and vertically positionable about the plurality of segments to drive a connector through the adjacent tubulars whereby a connection is formed between the adjacent tubulars.

2. The clam assembly of claim 1, further comprising an orienter carried by the plurality of segments, the orienter engageable with a reference component of the adjacent tubulars whereby the plurality of segments is orientable about the adjacent tubulars.

3. The clam assembly of claim 2, wherein the orienter comprises an upper receptacle and a lower receptacle.

4. The clam assembly of claim 3, wherein the upper receptacle comprises a pair of arms defining an inlet to grippingly receive the reference component.

5. The clam assembly of claim 3, wherein the lower receptacle comprises a plate defining a fixed inlet to receive the reference component.

6. The clam assembly of claim 1, wherein the plurality of segments are pivotally connectable together.

7. The clam assembly of claim 1, wherein each of the plurality of segments comprise an upper plate and a lower plate with the at least one drive mechanism therebetween.

8. The clam assembly of claim 1, wherein the driver comprises a rotational driver.

9. The clam assembly of claim 1, wherein the base comprises an axial rail, the driver movably coupled to the axial rail by a rail bracket.

10. The clam assembly of claim 1, wherein the base comprises a ratchet base, the driver movably coupled to the axial rail by a rail bracket.

11. A connection assembly for connecting adjacent tubulars positionable in a wellbore of a wellsite for passing fluid through the adjacent tubulars, the connection assembly comprising:

a base having a hole to receive the adjacent tubulars therethrough;

a carrier positionable about the base; and a clam assembly movably positionable along the carrier between a retracted position a distance from the tubulars and an extended position about the adjacent tubulars, the clam assembly comprising:

a plurality of segments selectively movable between an open position to receive the adjacent tubulars and a closed position positionable around the adjacent tubulars, the plurality of segments disposable about a periphery of the adjacent tubulars;

at least one drive mechanism carried by the plurality of segments, each of the at least one drive mechanisms comprising a driver radially fixed to the plurality of segments and vertically positionable about the plurality of segments to drive a connector through the adjacent tubulars whereby a connection is formed between the adjacent tubulars.

12. The connection assembly of claim 11, wherein the carrier comprises carrier rails, the clam assembly operatively connectable to the carrier rails and slidably positionable therealong.

13. The connection assembly of claim 11, wherein the carrier comprises a support operatively connectable to the carrier rails, the clam assembly carried by the support.

14. The connection assembly of claim 11, wherein the base comprises a plurality of clamps operatively connectable to the adjacent tubulars.

15. The connection assembly of claim 11, wherein the base is operatively connectable to a platform at the wellsite.

16. The connection assembly of claim 11, wherein the base is a spider.

17. The connection assembly of claim 11, wherein the clam assembly further comprises an orienting bracket carried by the plurality of segments, the orienting bracket engageable with a reference component of the adjacent tubulars whereby the clam assembly is orientable about the adjacent tubulars.

18. A method of connecting adjacent tubulars positionable in a wellbore of a wellsite for passing fluid through the adjacent tubulars, the method comprising:

closing a clam assembly about the adjacent tubulars, the clam assembly comprising:

a plurality of segments selectively movable between an open position to receive the adjacent tubulars and a closed position positionable around the adjacent tubulars, the plurality of segments disposable about a periphery of the adjacent tubulars;

at least one drive mechanism carried by the plurality of segments, each of the at least one drive mechanisms comprising a driver radially fixed to the plurality of segments and vertically positionable about the plurality of segments to drive a connector through the adjacent tubulars; and forming a connection between the adjacent tubulars with the connector by advancing the connector between a retracted and an extended position with the driver.

19. The method of claim 18, wherein the clam assembly further comprises an orienting bracket carried by the plurality of segments, and wherein the method further comprises orienting the clam assembly about a reference component of the adjacent tubulars by grippingly engaging the reference component with the clam assembly.

20. The method of claim 18, further comprising opening the clam assembly.

21. The method of claim 20, further comprising extending the clam assembly to the adjacent tubulars.

22. The method of claim 20, further comprising retracting the clam assembly from the adjacent tubulars.

23. The method of claim 18, wherein the forming comprises rotating the connector.

24. The method of claim 18, further comprising movably positioning the clam assembly between a retracted position a distance from the adjacent tubulars and an extended position about the adjacent tubulars.

* * * * *